US008484774B2

(12) United States Patent
Cohen et al.

(10) Patent No.: US 8,484,774 B2
(45) Date of Patent: Jul. 16, 2013

(54) CONTINUOUSLY HEIGHT ADJUSTABLE BABY MATTRESS SUPPORT AND APPARATUS THEREFOR

(75) Inventors: Yehuda Cohen, Petach Tikva (IL); Meir Gitelis, Moshav Shafir (IL)

(73) Assignee: M&J Srour Properties LLC, Piscaraway, NJ (US)

( * ) Notice: Subject to any disclaimer, the term of this patent is extended or adjusted under 35 U.S.C. 154(b) by 533 days.

(21) Appl. No.: 12/733,182

(22) PCT Filed: Aug. 19, 2008

(86) PCT No.: PCT/IL2008/001138

§ 371 (c)(1),
(2), (4) Date: Feb. 16, 2010

(87) PCT Pub. No.: WO2009/024972

PCT Pub. Date: Feb. 26, 2009

(65) Prior Publication Data

US 2010/0162482 A1 Jul. 1, 2010

(51) Int. Cl.
*A47D 7/03* (2006.01)
*A47D 7/00* (2006.01)

(52) U.S. Cl.
USPC ..... 5/93.1; 5/11

(58) Field of Classification Search
USPC ..... 5/11, 93.1, 611
See application file for complete search history.

(56) References Cited

U.S. PATENT DOCUMENTS

| | | | | | |
|---|---|---|---|---|---|
| 2,504,324 | A * | 4/1950 | Goldstein | 5/100 |
| 2,599,296 | A | 6/1952 | Toomey et al. | |
| 2,650,371 | A * | 9/1953 | Showalter | 5/11 |
| 4,285,079 | A | 8/1981 | Hillman | |
| 4,768,242 | A * | 9/1988 | LoTurco | 5/93.1 |
| 5,056,170 | A * | 10/1991 | Kronshagen | 5/10.1 |
| 5,063,624 | A | 11/1991 | Smith et al. | |
| 5,377,787 | A * | 1/1995 | Chabrier | 187/404 |
| 5,747,745 | A | 5/1998 | Neuman | |
| 6,629,322 | B1 | 10/2003 | Monroe | |
| 7,827,631 | B2 * | 11/2010 | Holman | 5/93.1 |
| 2002/0130286 | A1 | 9/2002 | Eckstein et al. | |
| 2010/0005586 | A1 * | 1/2010 | Kappenberg | 5/100 |

FOREIGN PATENT DOCUMENTS

| | | |
|---|---|---|
| DE | 196 22 937 A1 | 12/1997 |
| GB | 2 287 315 A | 9/1995 |
| GB | 2 422 303 A | 7/2006 |
| GB | 2 429 400 A | 2/2007 |
| IT | 1238733 | 5/1990 |

* cited by examiner

*Primary Examiner* — Michael Trettel

(74) *Attorney, Agent, or Firm* — Birch, Stewart, Kolasch & Birch, LLP

(57) ABSTRACT

A continuously height adjustable mattress support and apparatus therefor is disclosed. The mattress support is vertically displaceable by means of at least one drive unit for applying a vertical force to a corresponding solely vertically displaceable driven component and is stabilized during vertical displacement by at least one stabilizing means connected thereto. The driven component is connected to, or is in supporting relation with, the mattress support, so that a height of the mattress support above a floor surface is settable and continuously adjustable by means of at least one actuator associated with the at least one drive unit. In one embodiment, a locking device for preventing displacement of the mattress support following inadvertent actuation of the at least one drive unit is employed.

24 Claims, 26 Drawing Sheets

144
147
156
157
158
162
172
157

163
167
165
166
161
160
159
147

176
181
144

175
153
155

176
147
177
153
176
159
164
161
169
173
171
177
168

160
164
176
177

CONTINUOUSLY HEIGHT ADJUSTABLE BABY MATTRESS SUPPORT AND APPARATUS THEREFOR

This National Phase PCT application claims priority under 35 U.S.C. 119(e) on U.S. Provisional Application No(s). PCT/IL2008/001138 filed on Aug. 19, 2008.

FIELD OF THE INVENTION

The present invention relates to the field of baby cribs. More particularly, the invention relates to apparatus by which the height of a mattress support may be continuously adjusted.

BACKGROUND OF THE INVENTION

Many height adjustable baby mattress supports are known in the prior art. The most commonly available height adjustable baby crib is one that requires manual disassembly of at least a portion of the crib main frame and of components such as brackets that attach the mattress support to the main frame. After the mattress support is positioned at a desired height, the brackets and main frame have to be reassembled.

Such types of baby cribs suffer from several disadvantages:

1. It is necessary to assemble and disassemble the main frame and mattress mattress support to accommodate the growth of the baby, causing user discomfort during a time consuming and awkward assembly operation.
2. When a baby needs to be diapered, cared for, or dressed, the attendant has to bend over the upper railing of the crib in order to access the baby. Intermittent bending motions of the attendant result in back pains since the mattress support is positioned at a set height, and it is inconvenient to change the height of the mattress support.
3. The main frame of prior art cribs is generally configured with means to set the mattress support at one of a predetermined number of height levels, e.g. three different height levels. Many attendants are desirous of setting the mattress support at one or more different levels.

Various continuously height adjustable baby mattress supports are also known in the prior art; however, the associated apparatus for adjusting the mattress support height is a relatively complex mechanism.

U.S. Pat. No. 2,599,296 discloses an adjustable crib spring which is arranged to be raised and lowered, two pairs of geared levers at each end of the crib and provided with tension springs to tend to draw them together to raise the crib spring, handles on the crib spring for manual movement of the latter, and catches on the crib. One lever at each end of the crib is connected to a corresponding lever at the other end of the crib by means of a shaft so that the levers are forced to move together and that tilting of the crib spring is prevented.

U.S. Pat. No. 4,285,079 discloses an apparatus by which a mattress support is raised and lowered by flexible hoist members attached to a winding bar that is rotatably journaled in two housings. The hoist members are threaded through the housings and attached to the winding bar. At their ends, the hoist members are secured by brackets to a spring frame that forms part of the mattress support.

IT 1238733 discloses a child's bed having a manually moveable mattress frame with a spring and gas piston system for guidance and counterweight.

GB 2422303 discloses a cot with a height-adjustable mattress base. Support means are provided taking the form of scissor-pivoted leg members. A switch controlling a linear actuator causes the leg members to be pushed open to lower the mattress or pushed together to raise the mattress.

It is an object of the present invention to provide an uncomplicated apparatus for continuously adjusting the height of a baby mattress support that includes only a few parts.

It is an additional object of the present invention to provide an apparatus for continuously adjusting the height of a baby mattress support that is easy to operate.

It is an additional object of the present invention to provide an apparatus for continuously adjusting the height of a baby mattress support that occupies a minimal volume.

Other objects and advantages of the invention will become apparent as the description proceeds.

SUMMARY OF THE INVENTION

The present invention provides a mattress support that can be adjusted to any desired height from a lowermost position to an uppermost position (hereinafter a "continuously height adjustable mattress support"), which is vertically displaceable by means of at least one drive unit for applying a vertical force to a corresponding solely vertically displaceable driven component and is stabilized during vertical displacement by at least one stabilizing means connected thereto, said driven component being connected to, or being in supporting relation with, said mattress support, wherein a height of said mattress support above a floor surface is settable and continuously adjustable by means of at least one actuator associated with said at least one drive unit.

A "mattress support", as referred to herein, is a single element, such as a board or a mattress spring, or a plurality of elements, such as a plurality of equally spaced slats, on which a mattress is supported. When the continuously height adjustable mattress support of the invention, together with the associated apparatus for effecting its vertical displacement in stabilized fashion, is provided in a baby crib, an attendant of the baby need not bend over the upper railing of the crib in order to access the baby as has been practiced hereinbefore with respect to prior art cribs since the mattress support can be effortlessly displaced to an uppermost position prior to accessing the baby. A crib comprising said apparatus has stationary end and side units, and precludes the need for a separate changing table.

Since the driven component is solely vertically displaceable by means of the drive unit associated therewith and not being displaceable in a horizontal or oblique direction, linkages that are expensive to manufacture, assemble and maintain are rendered unnecessary.

The term "connected to" means that said driven component and said stabilizing means may be directly or indirectly connected to said mattress support. The driven component may also be connected directly or indirectly to the corresponding drive unit.

Each of the drive units may be electrically, hydraulically, pneumatically, or manually actuated.

As referred to herein, the "stabilizing means" when connected to the mattress support is a device for absorbing the torque resulting from an excessive load on one side of the mattress support. The stabilizing means is selected from the group of one or more vertically oriented rail portions, e.g. telescopingly extendable rail portions, a vertically oriented linear bearing, and stabilizing means that is integral with the at least one drive unit, or a combination thereof.

In one aspect, the linear bearing comprises two vertically spaced runners that are slidably engaged with common tracks of a rail attached to a crib end unit. The use of two runners cancels the torque that would be applied to the linear bearing when a baby stands at one end of the mattress.

In one aspect, an attachment plate, e.g. an L-shaped plate, connected to the runners is also connected to the mattress support. The attachment plate is preferably connected to a single frame element in which the mattress support is mounted and connected.

In a first embodiment, the driven component is a vertically oriented piston rod of each of two gas spring cylinders attached to two end units, respectively, of a baby crib, wherein an attachment plate is attached to the piston rod and to the frame element.

In one aspect, the actuator is adapted to displace two piston rods simultaneously.

In a second embodiment, the driven component is a vertically oriented piston rod reciprocating with respect to a corresponding cylinder, for applying a vertical force to a mattress support underside, said cylinder being attached to an end unit of a baby crib and interposed between two stabilizing means, wherein a vertically oriented leg of an angled element protruding from the underside of the mattress support is attached to a corresponding stabilizing means.

In one aspect, counterweight means, e.g. a spring, is attached to the mattress support underside and to an additional stabilizing means.

In a third embodiment, the drive unit is mounted within a crib leg post that is hollowed out, a vertically oriented groove being formed along a face of the leg post to allow insertion therein of the drive unit.

In one aspect, the drive unit comprises a piston housing, a vertically oriented piston reciprocating with respect to said piston housing, a horizontally disposed crossbar extending from said piston through the groove and connected to, or in supporting relation with, the mattress support. The actuator comprises a fixed handle for controlling a direction of displacement extending from an uppermost portion of the piston, and a release member extending from the piston and interposed between the handle and the crossbar, said release member adapted to enable vertical displacement of the piston when pulled towards the handle.

In one aspect, the drive unit comprises an electrically operated motor, a motor housing and a vertically disposed screw element which is threadedly engaged with the motor so as to be vertically displaceable, a collar element threadedly engaged with the screw element, and a horizontally disposed crossbar extending from said collar element through the groove and connected to, or in supporting relation with, the mattress support.

In a fourth embodiment, the drive unit is a telescoping piston unit having a planar base placed on a floor surface and an upper planar abutting member connected to, or in supporting relation with, an underside of the mattress support. The piston unit is hydraulically, pneumatically, or electrically actuated.

In one aspect, a first vertically oriented leg is connected to the base and a second vertically oriented leg is connected to the abutting member, said second leg being coupled to said first leg, e.g. by a grooved connection.

The present invention also provides apparatus for continuously adjusting the height of a baby crib mattress support, comprising:

a. at least one drive unit for applying a vertical force to a corresponding solely vertically displaceable driven component, said driven component being connected to, or being in supporting relation with, a horizontal mattress support;

b. at least one stabilizing means connected to a baby crib side unit or end unit and to said mattress support; and c. at least one actuator associated with said at least one drive unit for setting a selected height of said mattress support above a floor surface.

In one embodiment, the apparatus comprises at least one drive unit for applying a vertical force to a corresponding solely vertically displaceable driven component, said driven component being connected to, or being in supporting relation with, a horizontal mattress support; and at least one actuator associated with said at least one drive unit for setting a selected height of said mattress support above a floor surface.

In another embodiment, the apparatus further comprises a locking device for preventing displacement of the mattress support following inadvertent actuation of the at least one drive unit.

The locking device comprises means for releasably engaging the drive unit actuator, a disengagement device in communication with said engaging means, and a disengagement actuator adapted to operate said disengagement device, operation of said disengagement device causing said engaging means to be released from the drive unit actuator.

DETAILED DESCRIPTION OF PREFERRED EMBODIMENTS

The present invention is a continuously height adjustable baby mattress support which can be set at any desired height level above a floor surface. The apparatus for adjusting the mattress support comprises a simple drive unit that includes a corresponding solely vertically displaceable driven component for urging the mattress support to be displaced in a similar direction. Prior art apparatus for continuously adjusting the height of a baby mattress support, in contrast, comprises a relatively complex mechanism including a driven component that is displaced in a direction that is not solely vertical, in order to accommodate linkage means connected to the mattress support that are also displaced in response to the driven component towards a direction that is not solely vertical, thereby increasing the cost and complexity of the apparatus.

Figure 1:
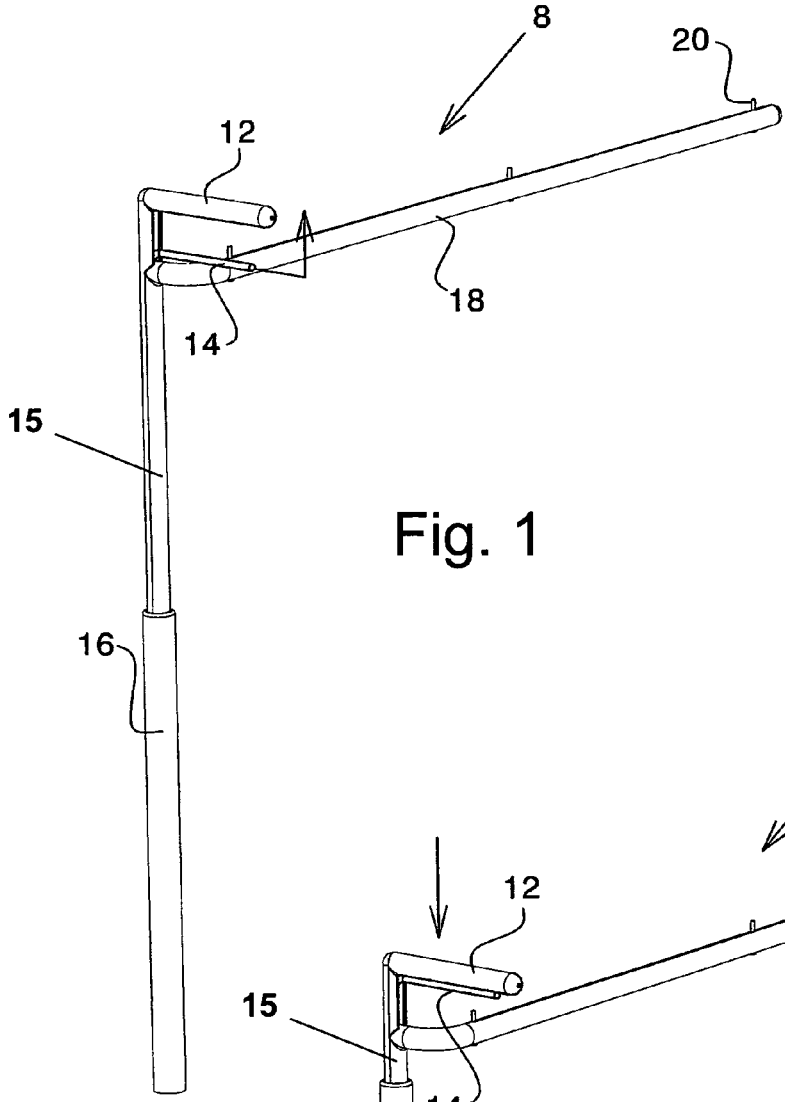
FIG. 1 is a perspective of a drive unit for continuously adjusting the height of a baby mattress support according to one embodiment of the invention, showing a crossbar in its uppermost position.

FIG. 1 illustrates a drive unit indicated generally by numeral 8 for continuously adjusting the height of a baby mattress support, according to one embodiment of the present invention. Drive unit 8 comprises a vertically disposed piston housing 16, a vertically disposed piston 15 shown in a fully raised position and which is adapted to be displaced downwardly within piston housing 16 when the mattress support is to be lowered and to be displaced upwardly when the mattress support is to be raised, a horizontally disposed crossbar 18 extending from piston 15, a fixed handle 12 extending from the uppermost portion of piston 15 which may be horizontally disposed and substantially perpendicular to the underlying crossbar 18, and a release member 14, which may be horizontally disposed, extending from piston 15 and interposed between handle 12 and crossbar 18, for enabling displacement of piston 15. Crossbar 18 is adapted to support the mattress support in cantilevered fashion, is made of, as well as piston 15 connected thereto, a sufficiently structurally strong material that can safely support the mattress support, as well as a mattress and infant positioned thereabove.

Figure 2:
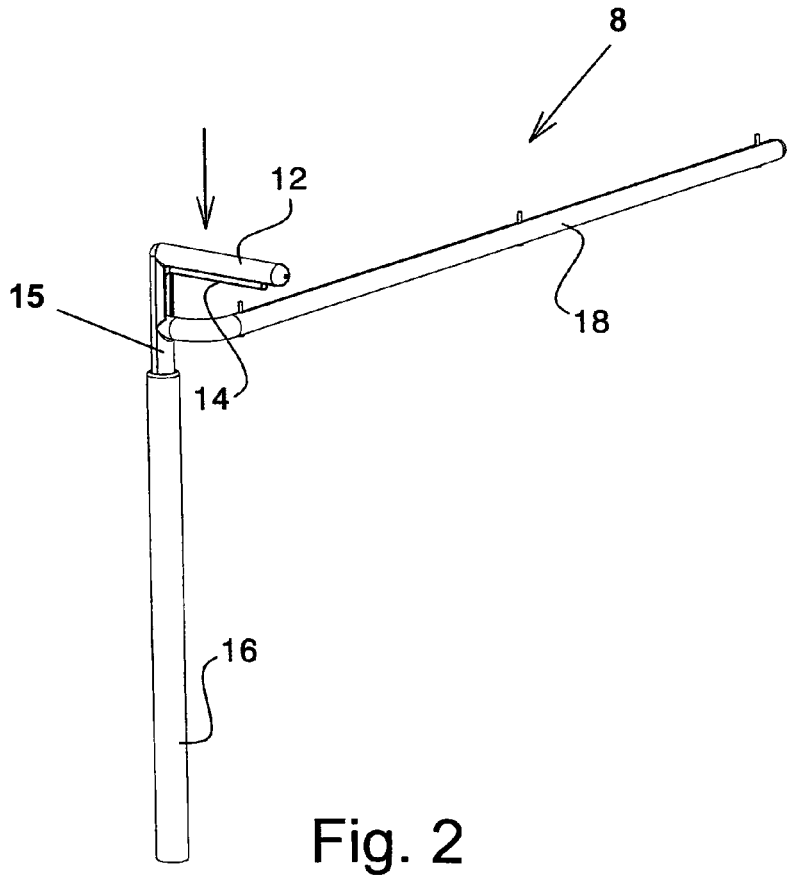
FIG. 2 is a perspective of the drive unit of FIG. 1 in which a crossbar is shown in its lowermost position.

FIG. 2 illustrates piston 15 in its lowermost position. When release member 14 is upwardly pulled towards handle 12, as shown, piston 15 is able to be lowered.

Figure 3:
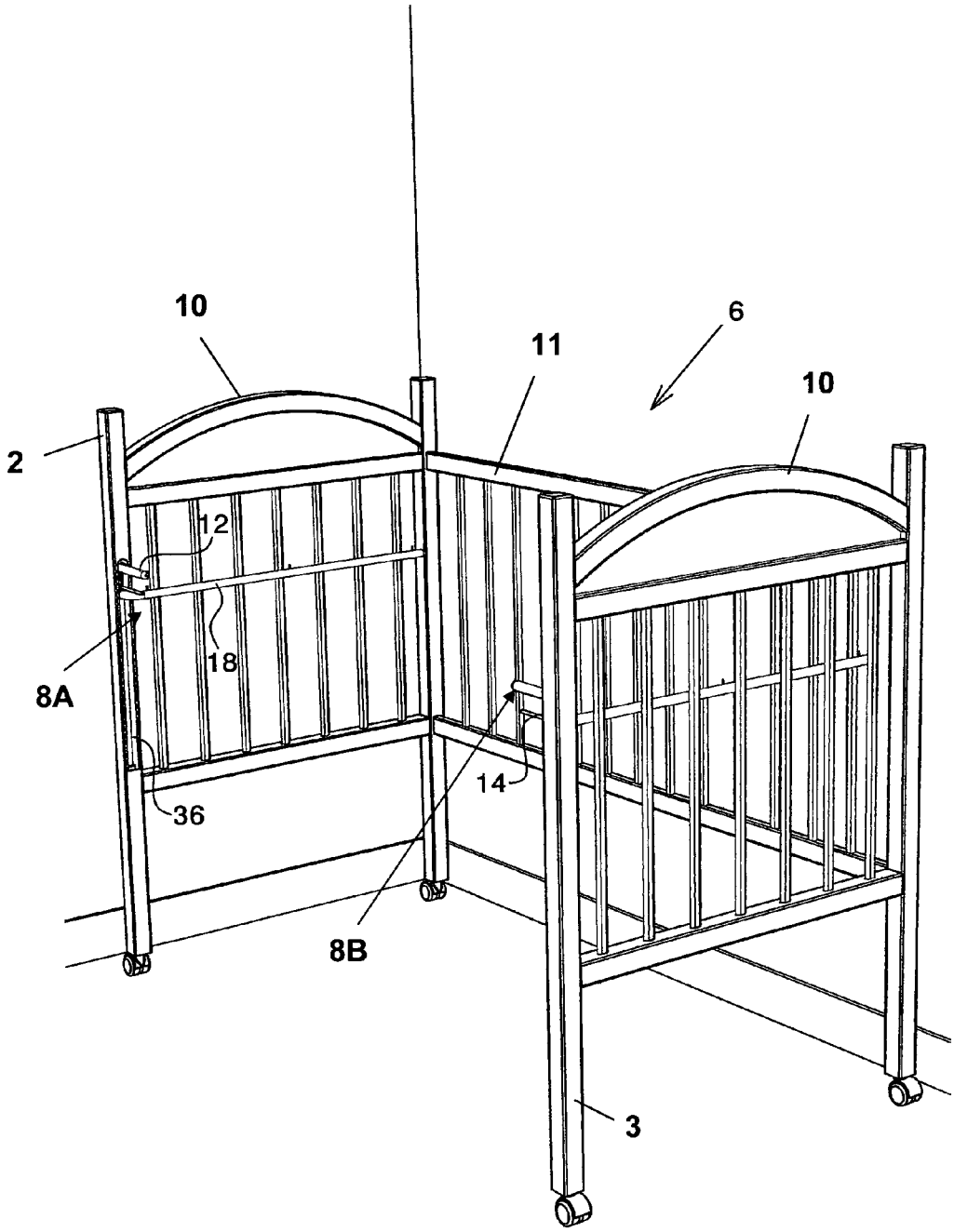
FIG. 3 is a perspective view of a baby crib from which one of its side units has been removed, showing two drive units of FIG. 1 that have been mounted within adjacent leg posts.

FIG. 3 illustrates a perspective view of a baby crib 6 from which one of its side units has been removed for clarity, in order to illustrate two drive units 8A and 8B that have been mounted within adjacent leg posts 2 and 3, respectively. Crib 6 comprises two opposing stationary end units 10 and two opposing stationary side units 11. As shown, adjacent leg posts 2 and 3 are hollowed out and a vertically oriented groove 36, e.g. an elliptical groove, is formed along opposed faces of leg posts 2 and 3, respectively, to allow insertion therein of a corresponding piston housing and piston and to allow the corresponding handle 12 and release member 14 to be freely displaced therealong when the height of the mattress support is being adjusted. After being inserted within the interior of a corresponding leg post, piston housing 16 contacts the inner wall of the leg post. The length of groove 36 is equal to, or greater than, the maximum difference in height of the mattress support between its uppermost and lowermost positions. The length of crossbar 18 is substantially equal to the width of the mattress support, extending along the length of the corresponding end unit 10 of crib 6 and terminating before contacting the second leg post from which the corresponding end unit is comprised. By mounting drive units 8A and 8B within leg posts 2 and 3, respectively, compactness of the height adjusting apparatus is maximized without compromising safety.

Figure 4:
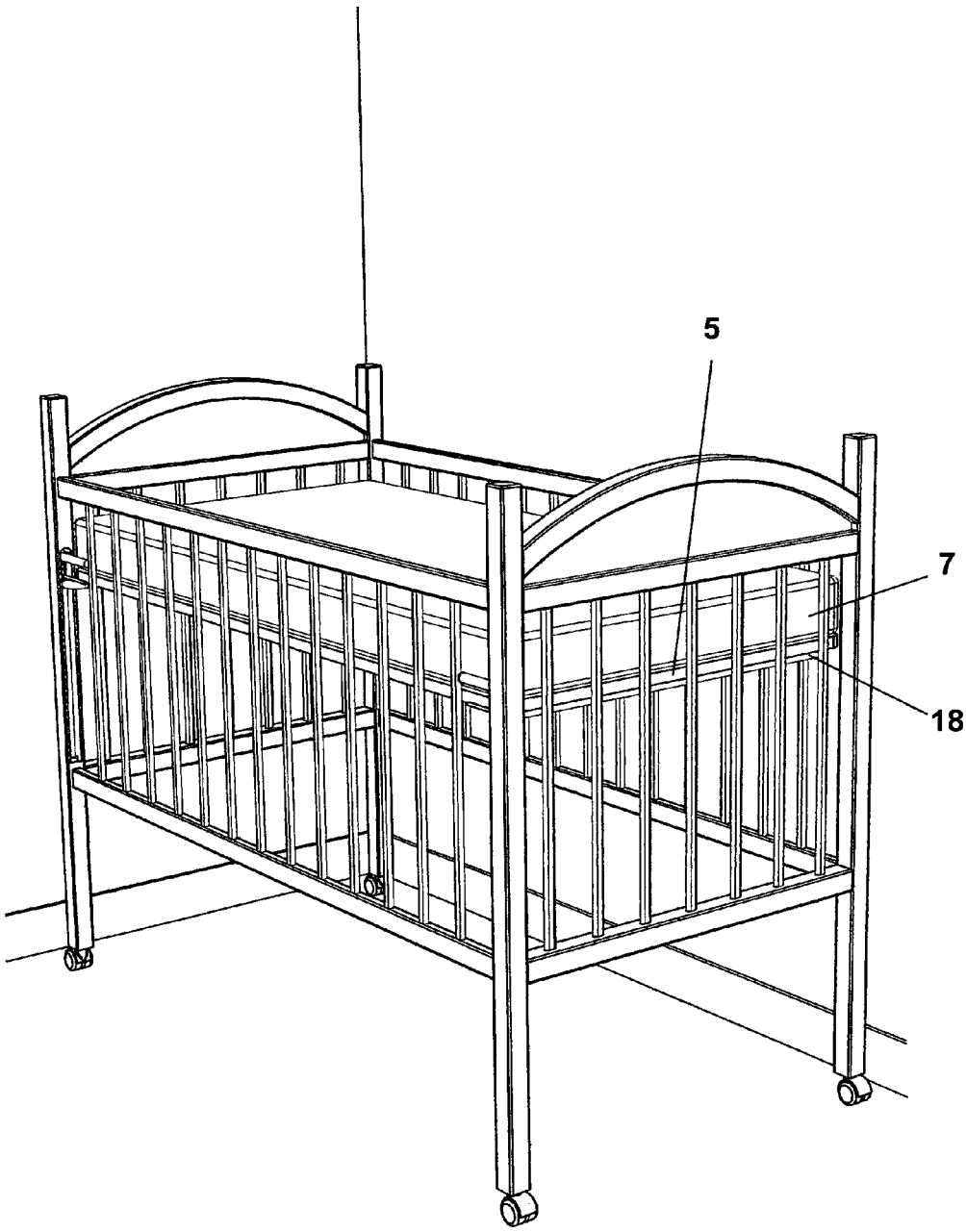
FIG. 4 is a perspective view of the baby crib of FIG. 4, showing its mattress support in an uppermost position.

FIG. 4 illustrates mattress support 5 at an uppermost position. The oppositely positioned pair of crossbars 18 support the mattress support 5 in cantilevered fashion, while mattress support 5 supports mattress 7. Crossbars 18, which may be tubular or of rectangular cross section, may be attached to mattress support 5 by means of screws 20 (FIG. 1) or any other suitable attachment means. Alternatively, crossbars 18 may support the mattress support without being attached thereto. It will be appreciated that any number of crossbars 18 from one to four may be employed to support the mattress support 5. When two crossbars are employed, they may extend along the width of support surface 5 as shown, or alternatively, may extend along the length thereof. Similarly, any number from one to four of drive units for vertically displacing a crossbar may be employed. When four drive units and two crossbars are employed, each crossbar is connected to two opposing pistons.

Figure 5:
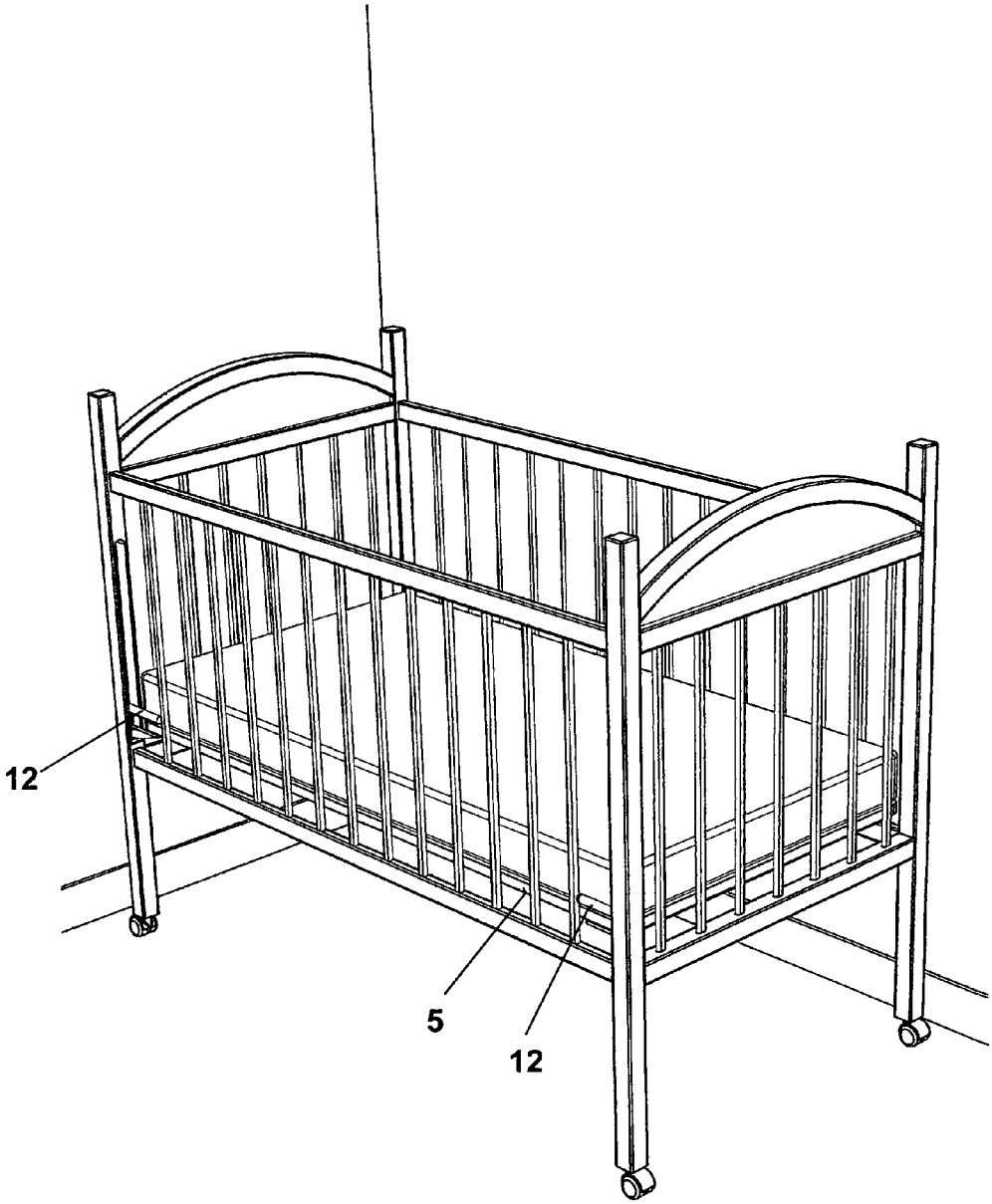
FIG. 5 is a perspective view of the baby crib of FIG. 4, showing its mattress support in a lowermost position.

FIG. 5 illustrates mattress support 5, as well as the two handles 12, at a lowermost position. By suitably manipulating the handles and release members, the height of mattress support 5 can be set at any desired value between the uppermost and lowermost positions. Accordingly, the use of a baby crib with the drive unit of the present invention obviates the need of a separate changing table since the height of the mattress support can be quickly and simply adjusted.

Figure 6:
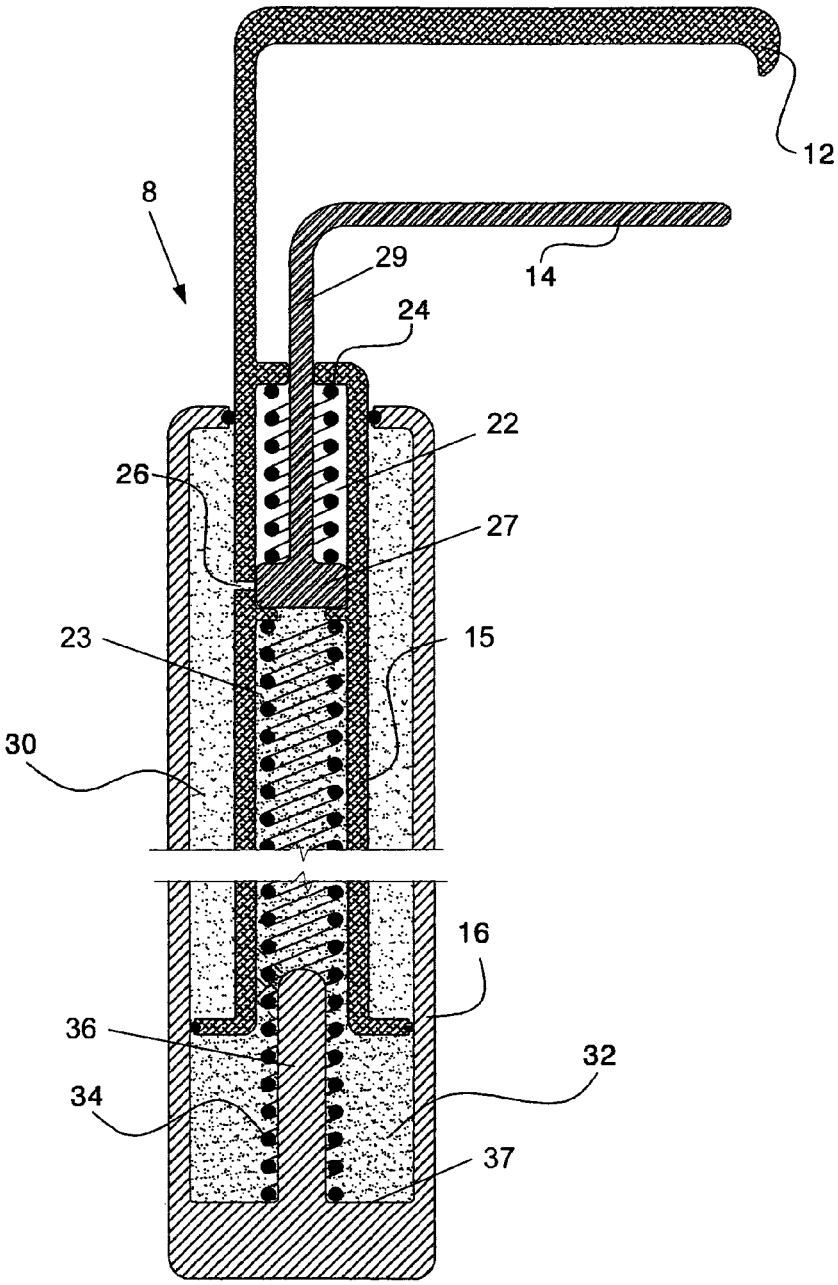
FIG. 6 is a vertical cross section of a hydraulically actuated piston used in conjunction with the drive unit of FIG. 1.

FIG. 6 illustrates a vertical cross sectional drawing of drive unit 8, showing the operation of hydraulically actuated piston 15. As shown, release member 14 has a plunger element 27 which sealingly engages the inner wall of, and is displaceable with respect to, piston 15, separating the hollow interior of piston 15 into variable-volume chambers 22 and 23. A vertical stem 29 extends from plunger element 27 to horizontal release member 14. Upper spring 24 is mounted about stem 29 within chamber 22, and lower spring 34 is disposed within chamber 23. Lower spring 34 is mounted about post 36 extending from the bottom surface 37 within the interior of piston housing 16. An aperture 26 in communication with chamber 23 is formed within a wall of piston 15. Upper spring 24 is biased when in a relaxed state to urge plunger element 27 to a position within the interior of piston 15 so as to occlude aperture 26.

In order to adjust the height of the mattress support, release member 14 is drawn towards handle 12, causing upper spring 24 to be contracted and aperture 26 to be exposed due to the displacement of plunger element 27. Hydraulic fluid then flows to chamber 23, assisting in the displacement of piston 15 upon application of a manual force to handle 12.

Figure 7:
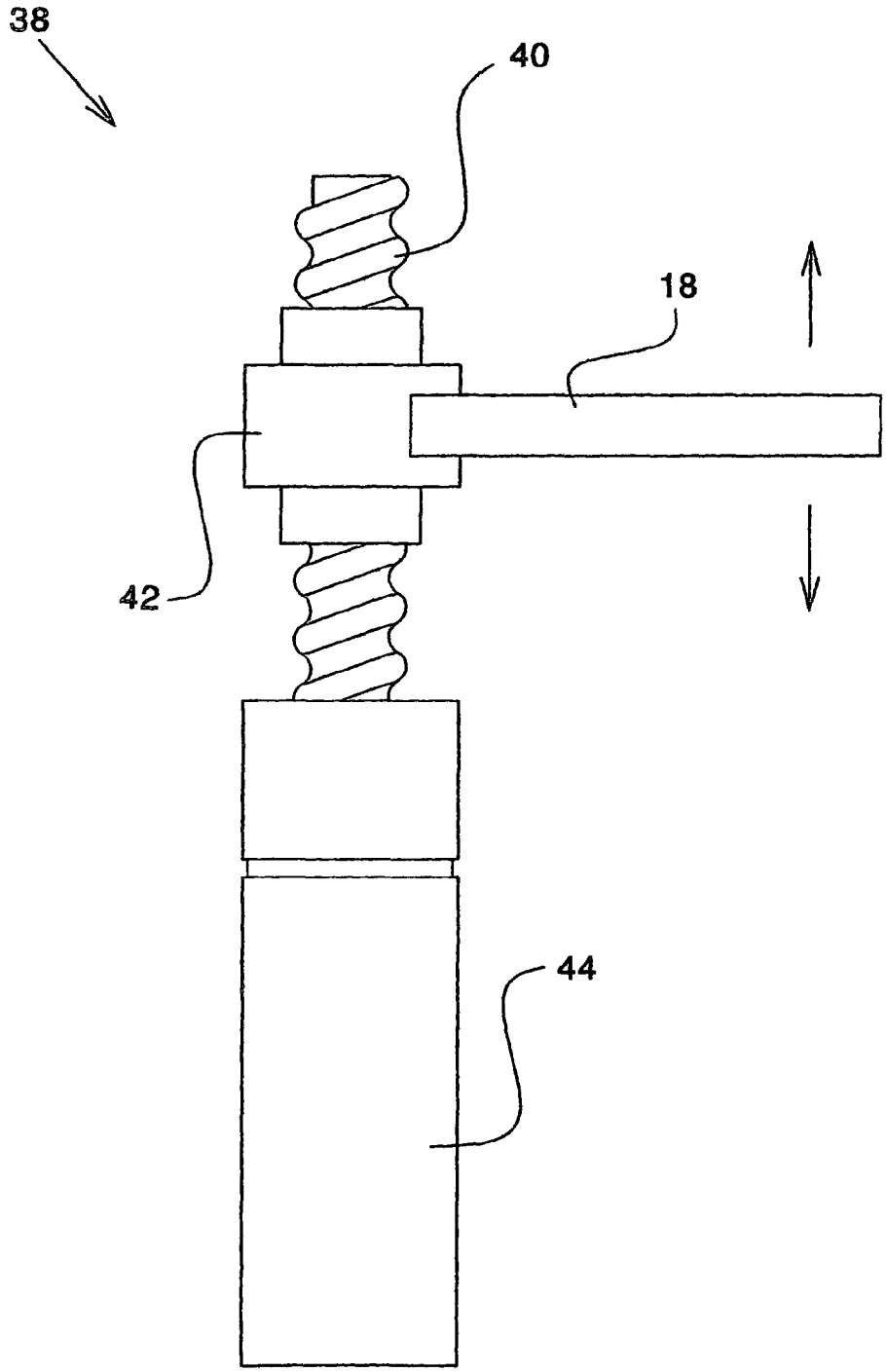
FIG. 7 is a front view of a drive unit according to another embodiment of the invention.

FIG. 7 illustrates an electrically actuated drive unit 38. Drive unit 38 comprises motor housing 44 insertable within a crib leg post, vertically disposed screw element 40 which is threadedly engaged with the electrically powered motor so as to be vertically displaceable, non-rotatable and vertically displaceable collar element 42 encircling and engageable with screw element 40, and solely vertically-displaceable and horizontally disposed crossbar 18 which is attached to collar element 42, thereby preventing the rotation of collar element 42. When connected to crossbar 18, a mattress support becomes continuously height adjustable.

It will be appreciated that screw element 40, or a vertically oriented element such as a rod, may be vertically displaced by means of a spring arrangement.

Figure 41:
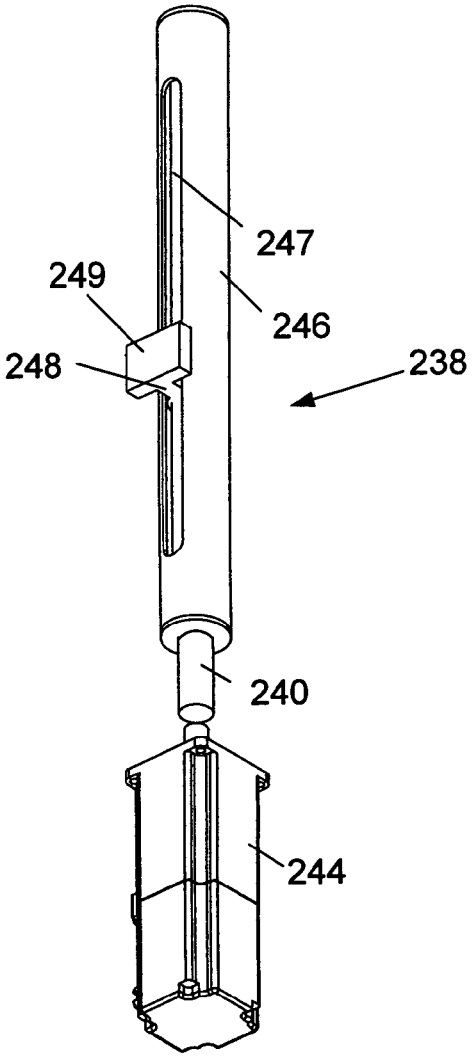
FIG. 41 is a perspective view of another embodiment of a drive unit.

Another electrically actuated drive unit is illustrated in FIG. 41. Drive unit 238 comprises stationary motor housing 244, vertically disposed screw element 240 which is threadedly engaged with the electrically powered motor so as to be vertically displaceable, tubular sleeve element 246 fixed to a portion of the baby crib, e.g. an end unit, which encircles screw element 240 and is formed with a vertical groove 247, protruding element 248 threadedly engaged with screw element 240 and which extends through groove 247, and solely vertically displaceable plate 249 attached to protruding element 248 so as to be vertically displaceable along groove 247. When connected to plate 249, a mattress support becomes continuously height adjustable.

FIGS. 8-13 illustrate another embodiment of the invention wherein a mattress support is vertically displaced by means of two pneumatically actuated pistons.

Figure 8:
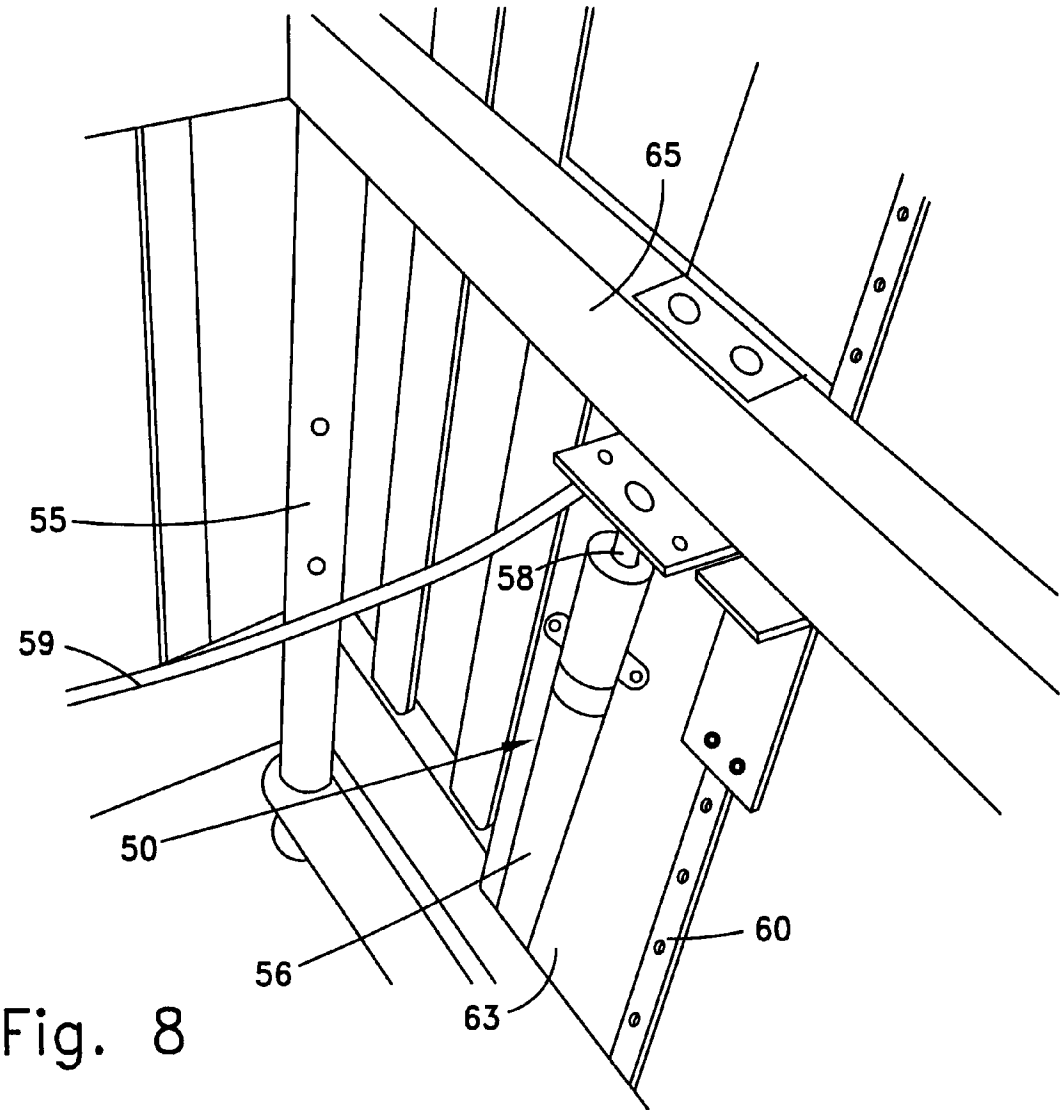
FIG. 8 is a perspective view of apparatus for continuously adjusting the height of a baby mattress support according to another embodiment of the invention.

FIG. 8 illustrates apparatus 50 associated with baby crib 55 for continuously adjusting the height of a baby mattress support. Apparatus 50 comprises cylinder 56, which is sometimes referred to as a "gas spring", piston rod 58 vertically reciprocating above and within cylinder 56, cable 59, e.g. a Bowden wire, coupled to piston rod 58 for effecting motion thereto, linear bearing 60 for stabilizing the mattress support as it is displaced vertically, and a horizontal frame element 65 to which piston rod 58 and linear bearing 60 are connected, as will described hereinafter. Gas spring 56 applies a force to vertically displace piston rod 58 by means of a compressed gas contained in a cylinder and a piston for variably compressing the gas. A pair of gas spring 56 and linear bearing 60 is attached to central portion 63 of each end unit of crib 55 in order to vertically displace a corresponding side of frame element 65. If will be appreciated that the linear bearings 60 may be attached to a side unit of crib 55, or to any other selected portion of the crib.

Figure 9:
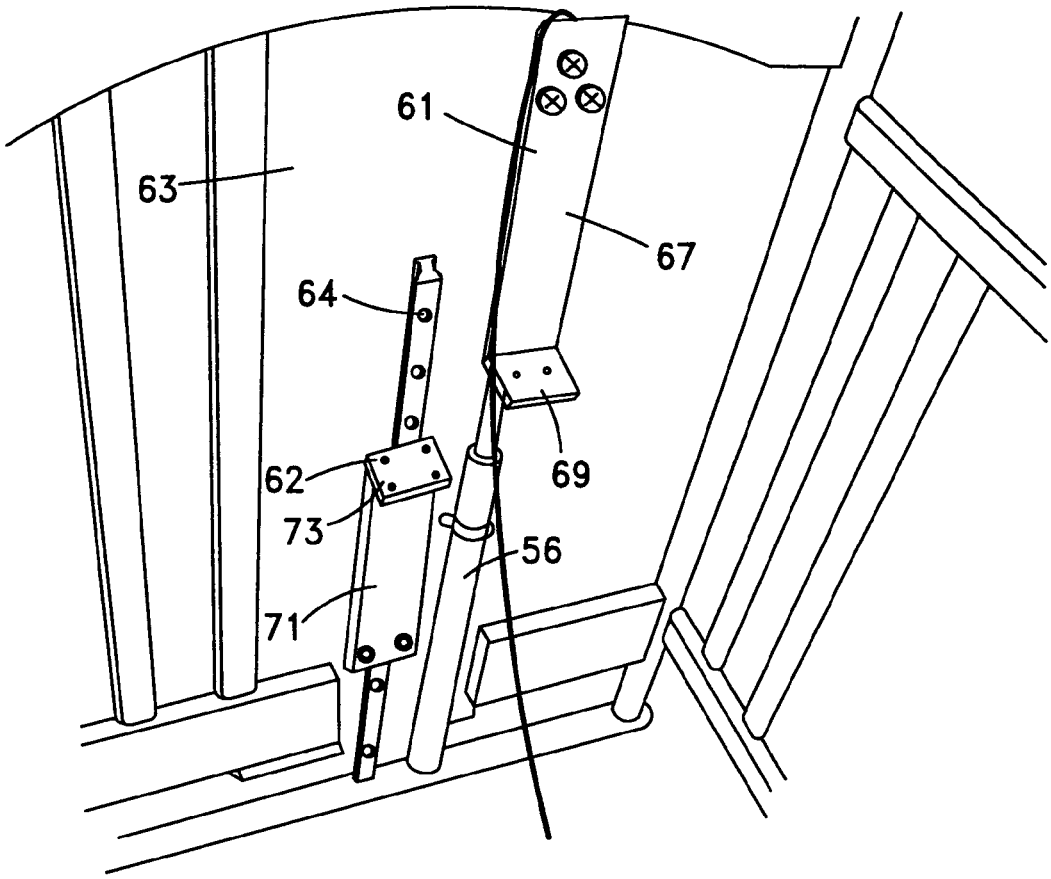
FIG. 9 is a perspective view of some of the apparatus of FIG. 8, showing attachment plates that are connected to a piston rod and linear bearing, respectively.

FIG. 9 illustrates two L-shaped attachment plates 61 and 62 that are connected to piston rod 58 and linear bearing 60, respectively. Elongated vertically oriented portion 67 is connected to piston rod 58, and terminates at its lower end with a short horizontally oriented leg portion 69 which is to be connected to the frame element. The maximum height of leg portion 69 above cylinder 56 is selected to set the uppermost height of the mattress support, and the lowermost height of the mattress support is set by the lowest height of leg portion 69 above floor surface F. Vertical portion 71 of attachment 62 is connected to the runners of linear bearing 60, and horizontal portion 73 thereof which is also to be connected to the frame element extends from the upper end of vertical portion 71.

Figure 10:
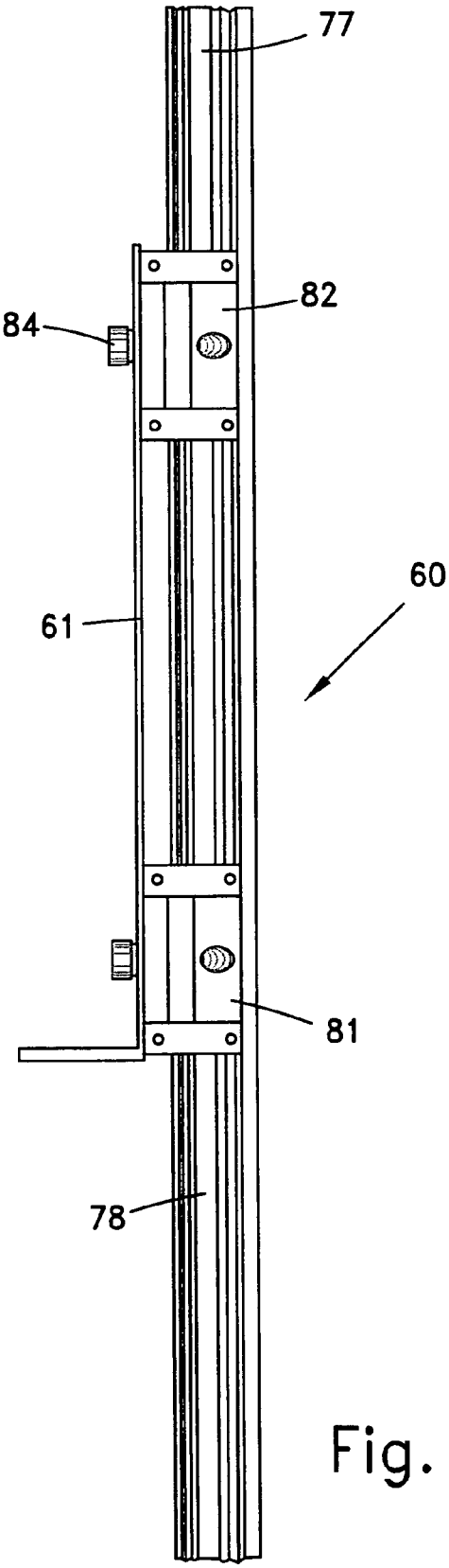
FIG. 10 is a side view of the vertically oriented linear bearing of FIG. 9.

As shown in FIG. 10, linear bearing 60 comprises vertically oriented rail 77 having a set of tracks 78 at each side thereof and fixed to central portion 63 of the crib by means of attachment means 64 (FIG. 9) introduced to each of a plurality of apertures bored in rail 77, two vertically spaced runners 81 and 82 slidably engaged with a common set of tracks 78, and attachment 61 connected to each of the two runners by attachment means 84, e.g. two bolts. The use of two runners cancels the torque that would be applied to the linear bearing when a baby stands at one end of the mattress. The construction of a linear bearing is well known to those skilled in the art, and need not be described for brevity. The BRH15A runner model manufactured by ABBA Linear Tech Co., LTD., Taiwan may be employed wherein the vertical spacing between each vertically spaced runner is 10-15 cm. The length of the rail may be 1.27 m and its width may be 0.6 m.

Figure 11:
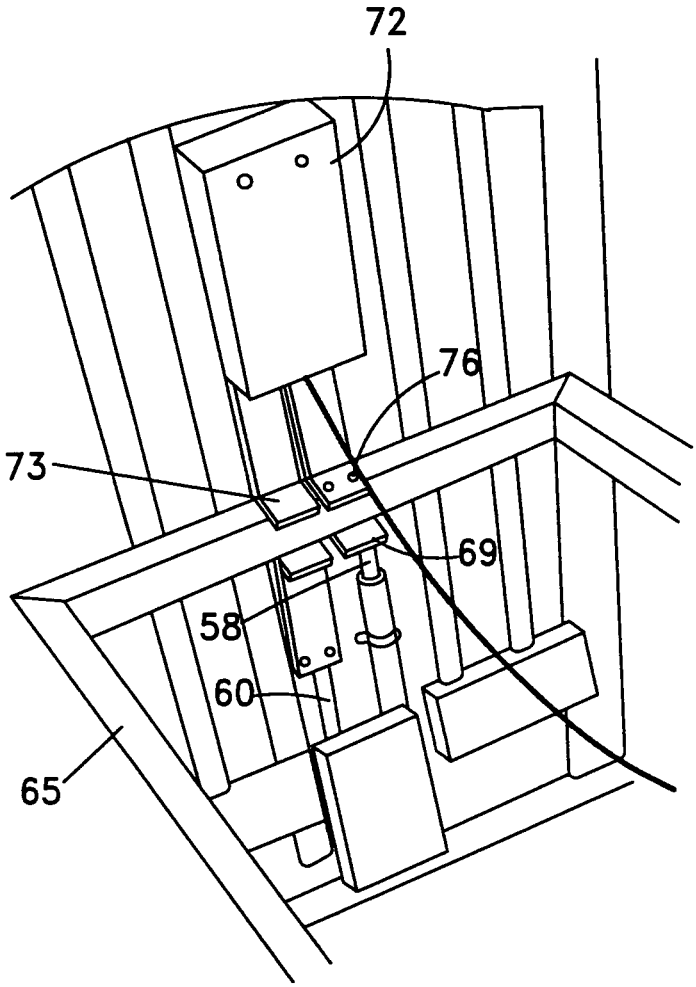
FIG. 11 is a perspective view of a frame element and attachment plate cover used in conjunction with the apparatus of FIG. 8.

In FIG. 11, frame element 65 is shown to be connected to piston rod 58 and linear bearing 60 by means of horizontal attachment portions 69 and 73, respectively. The attachment portions may be connected above or below frame element 65. A bracket portion 76 connected to a corresponding horizontal attachment portion, as shown, may also be attached to frame element 65, if so desired. When a linear bearing is employed, tests conducted by the applicants have revealed that torque resulting from the application of an excessive load on one end of the crib is absorbed by the frame element only when it is a single integral unit. A cover 72 for covering the attachment portions as well as other apparatus associated with the invention in a safe and aesthetic fashion as the mattress support is vertically displaced may be provided. Cover 72 may be made of plastic, rubber, or any other suitable material, and may be associated with another cover element made of similar materials. For example, cover 72 may be permanently fixed to piston rod 58 and linear bearing 60, and may be periodically introduced within the interior of the other cover element. The other cover element may also be configured so as to be introduced within the interior of cover 72. Alternatively, the other cover element may be compressed when brought in contact with cover 72.

Figure 12:
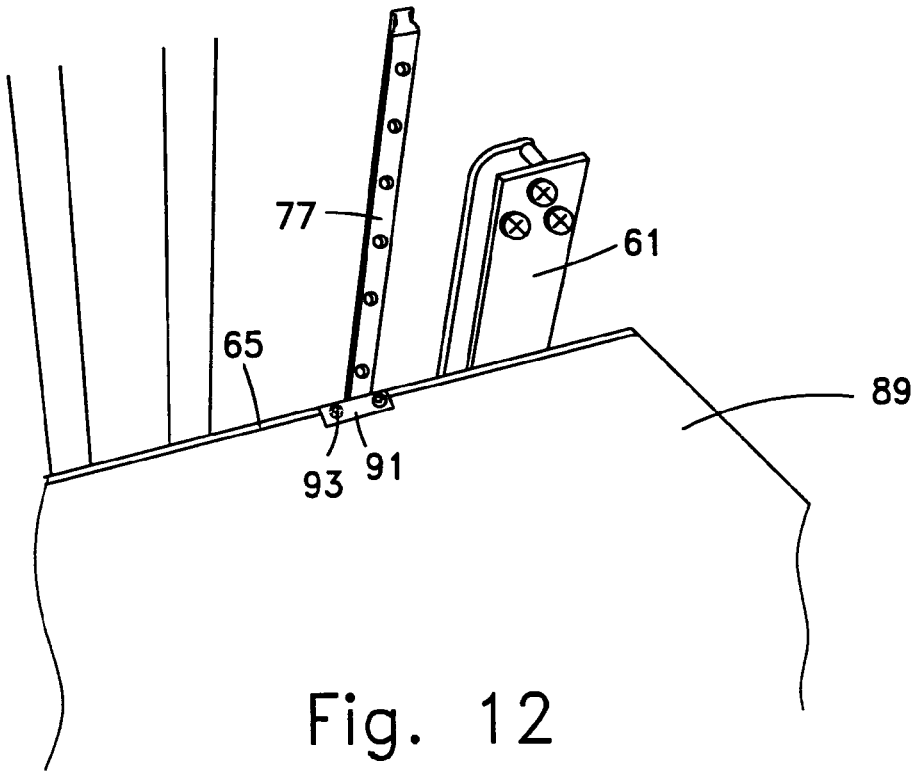
FIG. 12 is a perspective view of a baby crib end unit to which is attached the apparatus of FIG. 8, showing a frame element connected to a mattress support.

In FIG. 12, a mattress support 89 is shown to be connected to frame element 65 by means of bracket element 91 and attachment means 93.

Figure 13:
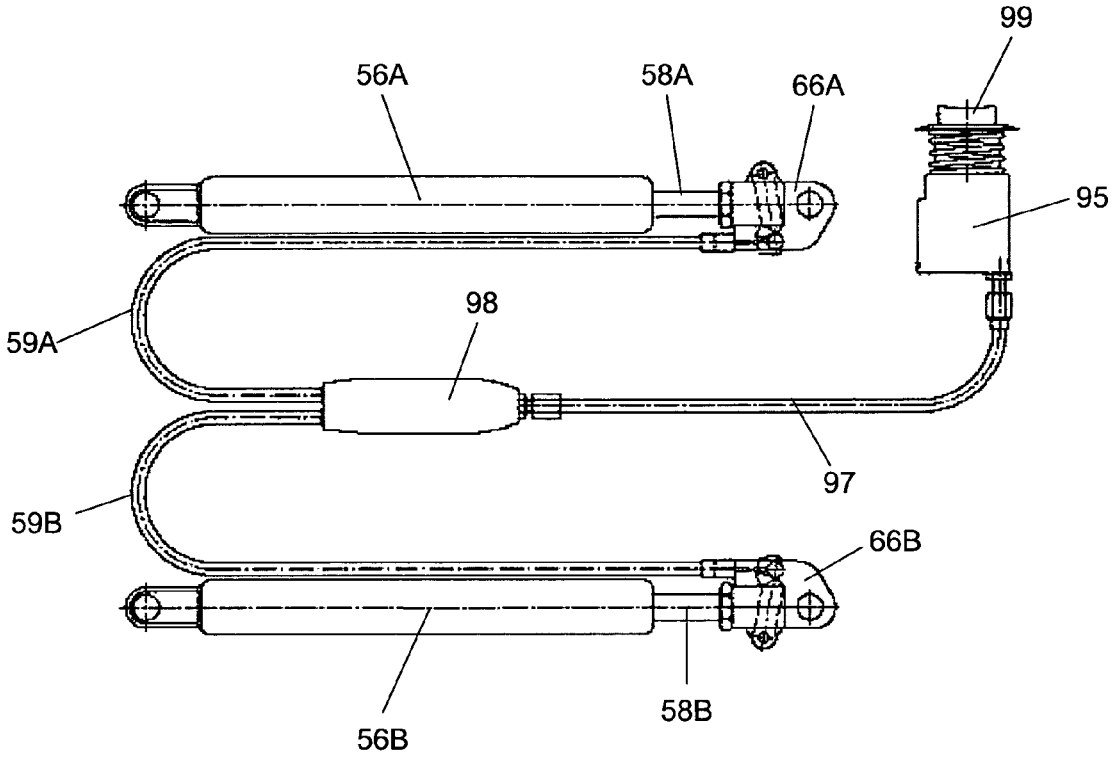
FIG. 13 is a schematic view of an actuator for simultaneously displacing two piston rods of oppositely mounted gas springs, respectively.

As shown in FIG. 13, the vertical displacement of two piston rods 58A and 58B with respect to cylinders 56A and 56B, respectively, each of which is connected to an opposite crib end unit, or if desired, to an opposite side unit, can be controlled simultaneously by means of a common actuator 95. Actuator 95, which is generally affixed to a crib side unit facing the interior of a room, is connected to a cable 97 extending to a splitter device 98, e.g. the Easytouch Slitter 20 SP1 manufactured by Bansbach Easylift GmbH, Germany, which directs the motion imparted by cable 97 simultaneously to cables 59A and 59B. Cables 59A and 59B are coupled to valve mechanisms 66A and 66B, respectively, for controlling the displacement of piston rods 58A and 58B, respectively. A spring biased button 99 may be associated with actuator 95 for controlling the motion of the piston rods, i.e. whether to be displaced upwardly, downwardly, or to be locked in position. Alternatively, a lever, or any other release member well known to those skilled in the art, may be associated with actuator 95 in order to release the two gas springs simultaneously. A B1B-3-28/10 gas spring model manufactured by Bansbach Easylift GmbH, Germany, having a stroke of 45 cm may be employed.

Figure 14:
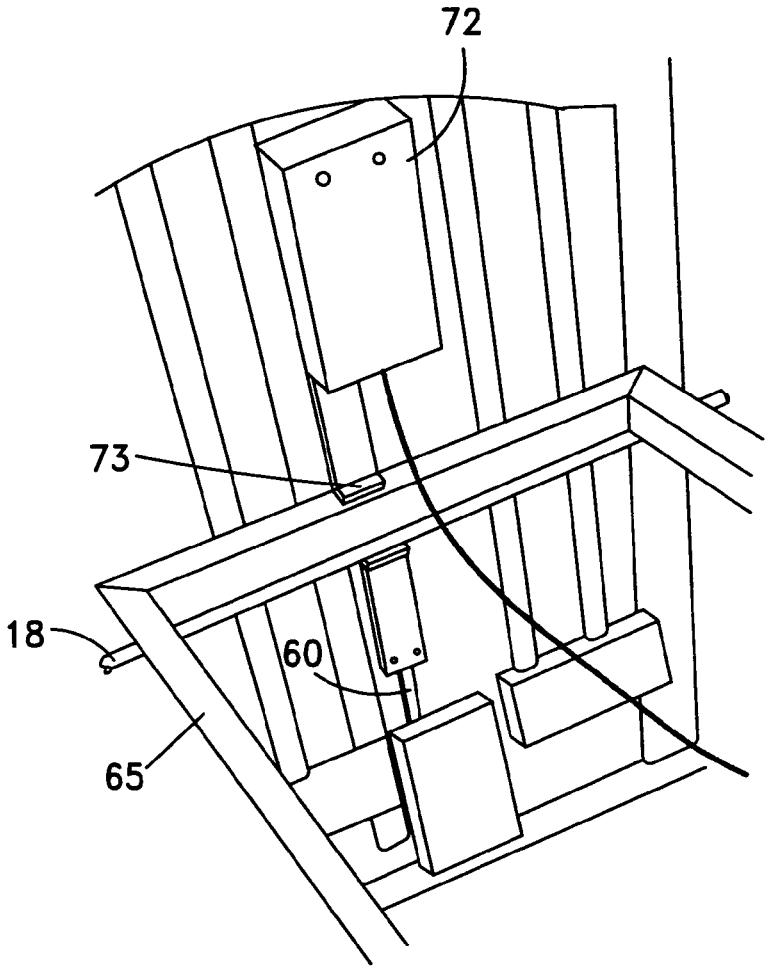
FIG. 14 is a perspective view of a crossbar of FIG. 1 attached to the underside of the frame element of FIG. 11.

A linear bearing for stabilizing the mattress support as it is displaced vertically may be employed in conjunction with any of the embodiments described hereinabove with respect to FIGS. 1-7. As shown in FIG. 14, crossbar 18 is connected to both linear bearing 60 and frame element 65.

Figure 15:
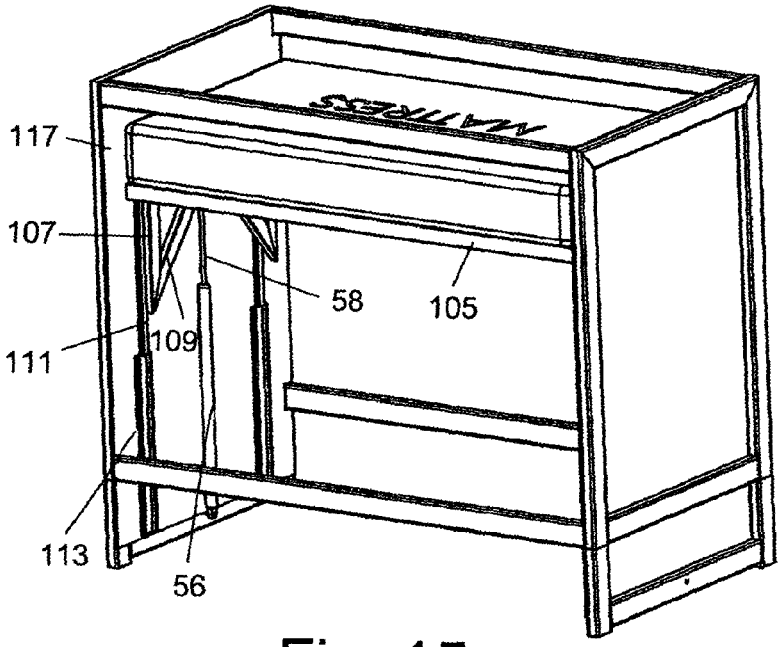
FIG. 15 is a perspective drawing of a baby crib, showing mattress support stabilization apparatus according to one embodiment of the invention while the mattress support is in an uppermost position.
Figure 16:
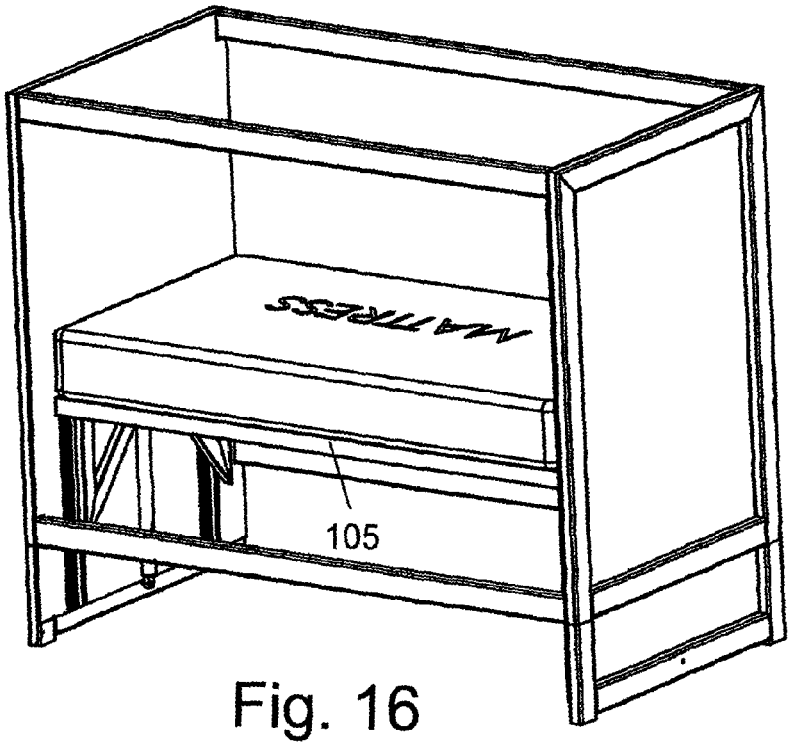
FIG. 16 is a perspective drawing of the baby crib of FIG. 15, showing the mattress support in a lowermost position.

FIGS. 15-16 illustrate another embodiment of the invention wherein a vertically oriented leg 107 of an angled element 109 protruding from the underside of mattress support 105 is fixedly attached to vertically oriented rail portion 111. Rail portion 111 is C-shaped and is provided with a plurality of ball bearings in the vicinity of its lips, so that it may be telescopingly extended from, and retracted within, base rail portion 113, which has a similar profile as rail portion 111 and is attached to crib end unit 117. A gas spring 56 is attached to each crib end unit 117 and is interposed between two telescoping rail portions 111, to each of which is attached a corresponding leg 107. Piston rod 58 is connected to the underside of mattress support 105 so that the latter will be vertically displaced in response to the motion of the piston rod, whether to a raised position as shown in FIG. 15 or to a lowered position as shown in FIG. 16.

Figure 39:
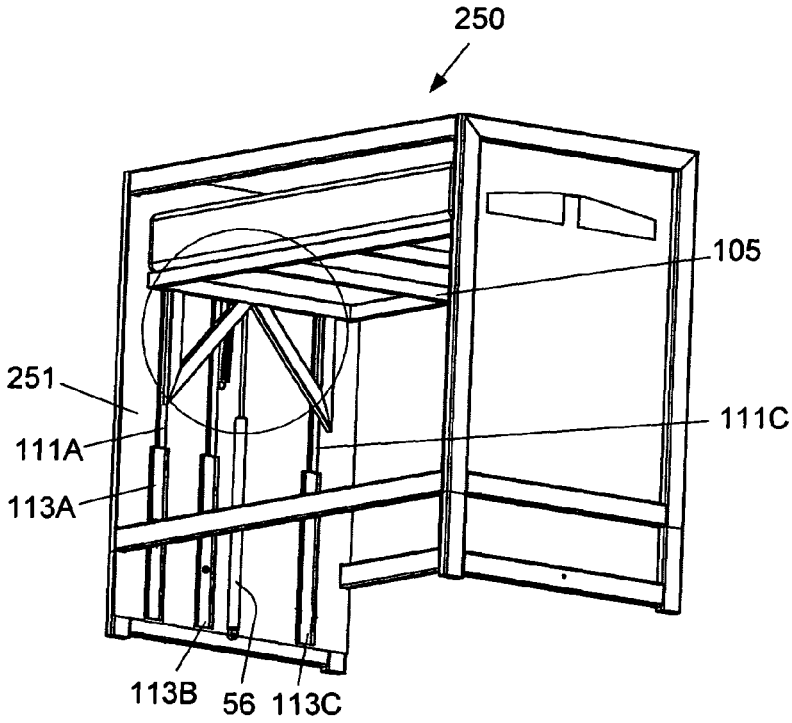
FIG. 39 is a perspective view of a baby crib, showing a spring attached to a rail portion for counteracting the weight of a baby.
Figure 40:
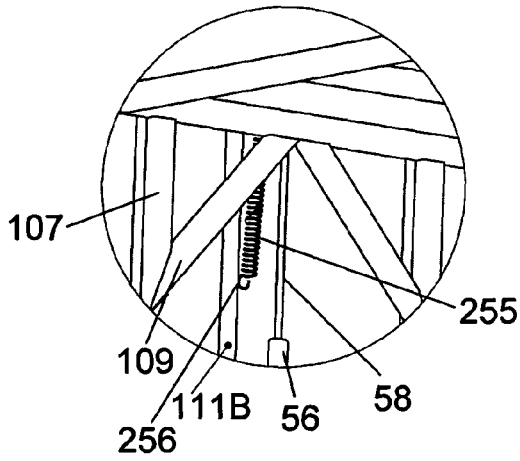
FIG. 40 is an enlarged view of FIG. 39.

In the embodiment shown in FIGS. 39-40, to each end unit 251 of crib 250 is connected three base rail portions 113A-C, from each of which is telescopingly extendable one or more vertically disposed rail portions 111A-C, respectively, and a gas spring 56 such that its piston rod 58 is connected to the underside of mattress support 105. Vertically oriented leg 107 of an angled element 109 protruding from the underside of mattress support 105 is fixedly attached to a corresponding vertically oriented rail portion 111 of base rail portions 113A and 113C. A spring 255 is attached at one end to mattress support underside 105 and at the other end to rail portion 111B, in order to counteract the weight of the baby and to thereby reduce the required force applied by gas spring 56. End 256 of spring 255 may be attached to different regions within rail portion 111B as the weight of the baby increases. If so desired, a replaceable counterweight may be used in lieu of the spring.

Figure 17:
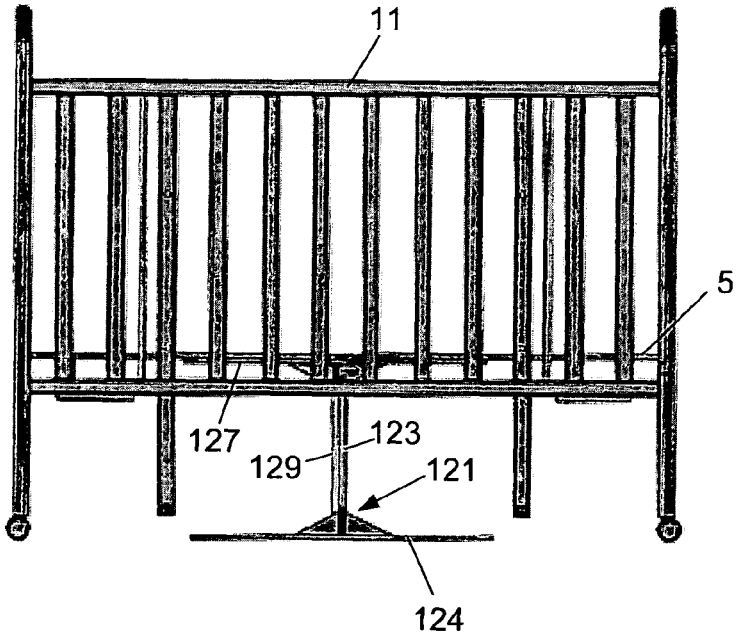
FIG. 17 is a side view of a baby crib to which is connected a drive unit according to another embodiment of the invention, showing the mattress support in a lowermost position.
Figure 18:
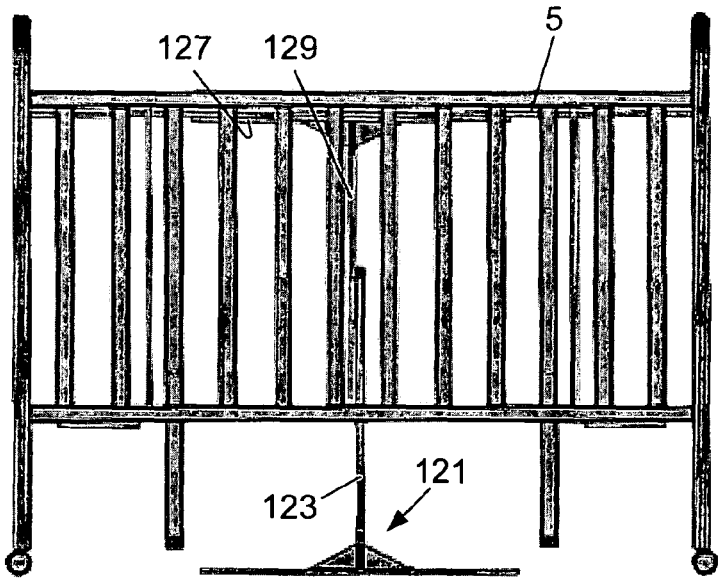
FIG. 18 is a side view of a baby crib to which is connected the drive unit of FIG. 17, showing the mattress support in an uppermost position.
Figure 19:
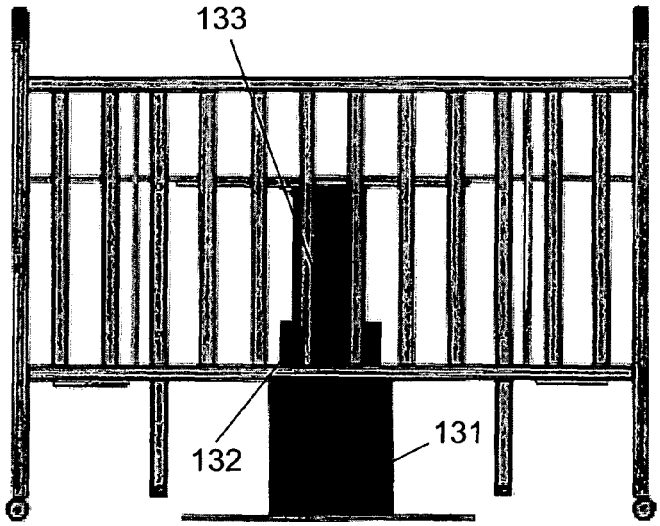
FIG. 19 is a side view of a baby crib to which is connected the drive unit of FIG. 17 covered by a three staged casing, showing the mattress support in an intermediate position.

FIGS. 17-19 illustrate another embodiment of the invention wherein mattress support 5 is continuously height adjustable by means of a telescoping piston unit 121. Piston unit 121, which may be hydraulically, pneumatically, or electrically actuated, has a planar base 124 placed on a floor surface to which is connected a first vertically oriented leg 123. A planar abutting member 127 to which is connected a second vertically oriented leg 129 is attached to the underside of mattress support 5. Second leg 129 is coupled to first leg 123 by a grooved connection. Alternatively, second leg 129 is fixedly coupled to first leg 123, and legs 123 and 129 may be simultaneously extendable. One piston unit 121 may be employed, being centered under mattress support 5, or two piston units may be employed, each of which being positioned adjacent a corresponding side unit 11. FIG. 17 shows mattress support 5 in its lowermost position, while FIG. 18 shows it in its uppermost position. FIG. 19 illustrates a three-staged casing 131-133 for the piston unit, so that at any height between the lowermost position and the uppermost position as shown, legs 123 and 129 may be locked in place.

FIGS. 20-37 illustrate one embodiment of a locking device 140 for preventing displacement of the mattress support following the inadvertent pressing of the release member of the drive unit actuator. A retractable pin 221 (FIG. 33), or any other releasable engagement means well known to those skilled in the art, normally locks the drive unit actuator, and only when a disengagement device is actuated as will be described hereinafter, the pin is released and the actuation of the drive unit is made possible.

Figure 20:
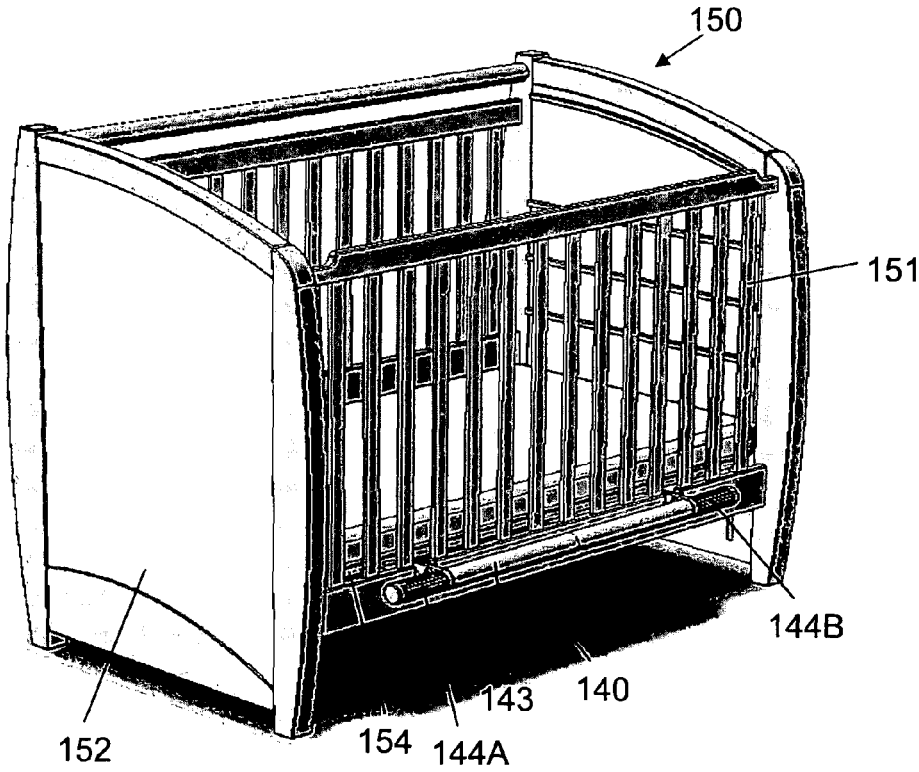
FIG. 20 is a perspective view of a baby crib, showing a locking device in a retracted position.

As shown in FIG. 20, locking device 140 comprises a horizontally oriented bar 143 interposed between two grips 144A and 144B. Grip 144A serves as the means for disengaging the pin from the drive unit actuator. Grip 144B serves as the means for actuating the drive unit. Bar 143 is illustrated in a retracted position with respect to side unit 151 when mattress support 154 is in a lowered position. Prior to disengaging the pin from the drive unit actuator, mattress support 154 is prevented from being vertically displaced. As bar 143 is not readily visible to a curious baby, accidental actuation of the pin release actuator or of the drive unit actuator is substantially impossible.

Figure 21:
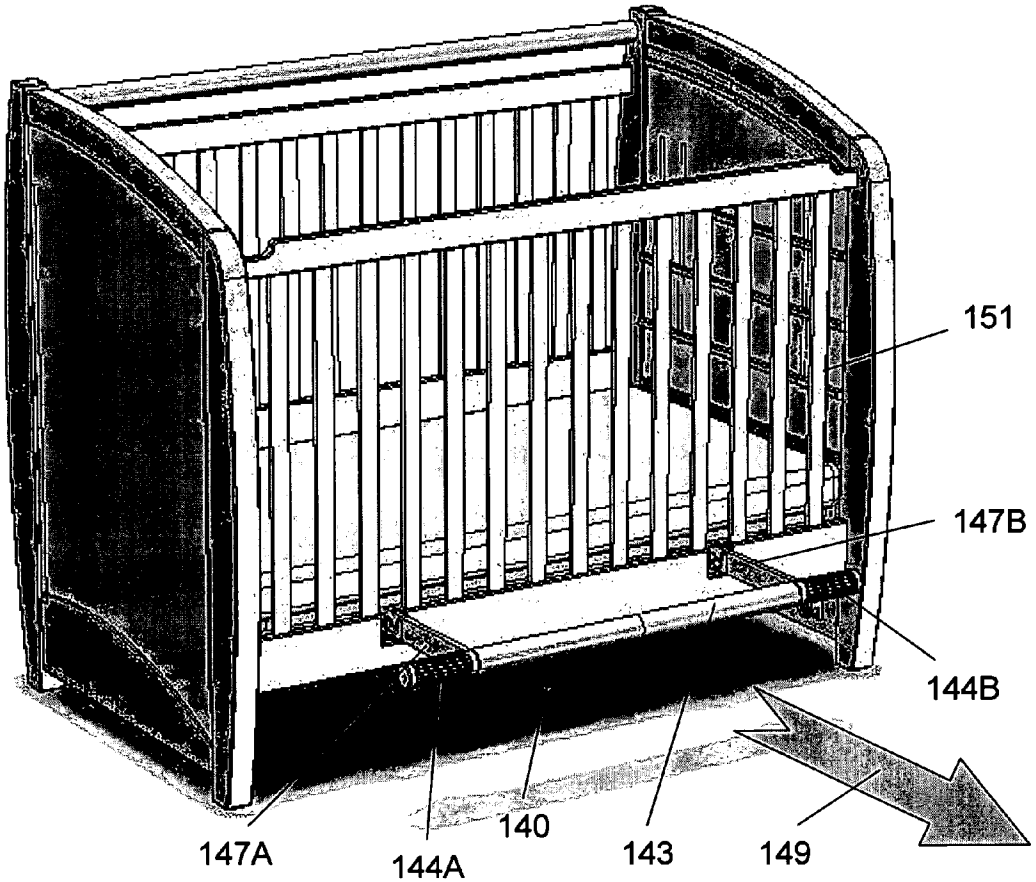
FIG. 21 is a perspective view of the baby crib of FIG. 20, showing the locking device in an extended position.

In FIG. 21, bar 143 is shown in an extended lowered position with respect to side unit 151. Bar 143 is brought to an extended position by pulling on grips 144A and 144B in the direction indicated by arrow 149. Arms 147A and 147B are fixed to, and extend inwardly from, grips 144A and 144B, respectively. Arms 147A and 147B may be made of plastic or of metal, and may be integrally fixed to grips 144A and 144B, respectively.

Figure 22:
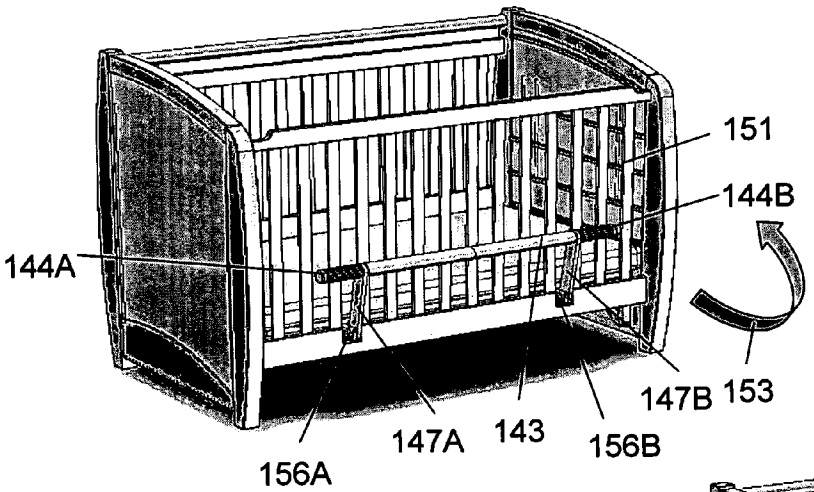
FIG. 22 is a perspective view of the baby crib of FIG. 20, showing the locking device in an upwardly rotated position.
Figure 23:
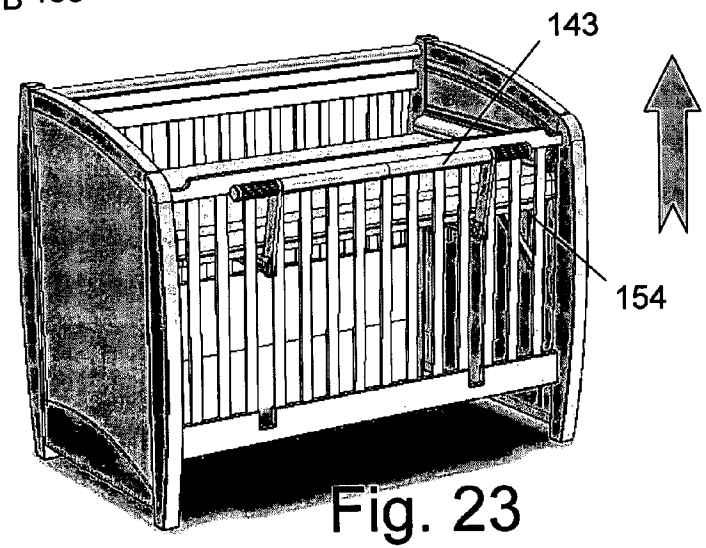
FIG. 23 is a perspective view of the baby crib of FIG. 20, showing the locking device in an upwardly rotated position while the mattress support is in a raised position.

In FIG. 22, bar 143 is shown to be in an upwardly rotated position, in order to simplify the actuation of the pin release actuator and of the drive unit actuator without having to bend to the lowermost portion of end unit 151. When arms 147A and 147B are pivoted with respect to grooved units 156A and 156B, respectively, by applying a force to grips 144A and 144B in the direction indicated by arrow 153, bar 143 is able to be upwardly pivoted. Bar 143 remains in the upwardly rotated position when mattress support 154 is upwardly displaced, as shown in FIG. 23. If so desired, bar 143 can be fixed in a downwardly rotated position.

An exemplary configuration of grooved unit 156 is illustrated in FIGS. 24-30. As shown, grooved unit 156 is substantially rectangular, and has planar top edge 162, bottom edge 172, and outer edges 157 substantially perpendicular to edges 162 and 172. Grooved unit 156 is formed with a through-hole, variably shaped guide groove 158. Guide groove 158 has an elongated central portion 159 defined by upper edge 160 and lower edge 161 parallel to upper edge 160, and an inner portion 163, i.e. positioned away from the direction of a crib side or end unit depending on the orientation of grooved unit 156, having an upper edge 165 coincident with upper edge 160 of the central portion, a lower edge 166 located above lower edge 161 of the central portion and a terminal arcuate edge 167 extending from upper edge 165 to lower edge 166. Outer portion 168 of guide groove 158 is C-shaped and has an upper edge 169 that is continuous with upper edge 160 of the central portion. Lower edge 161 of the central portion terminates with a protuberance 164 that constricts the interspace of outer portion 168. Lower edge 171 of outer portion 168 has a concave edge 173 that abruptly extends downwardly adjacent to protuberance 164.

Figures 24, 25, 26, 27, 28, 29, 30:
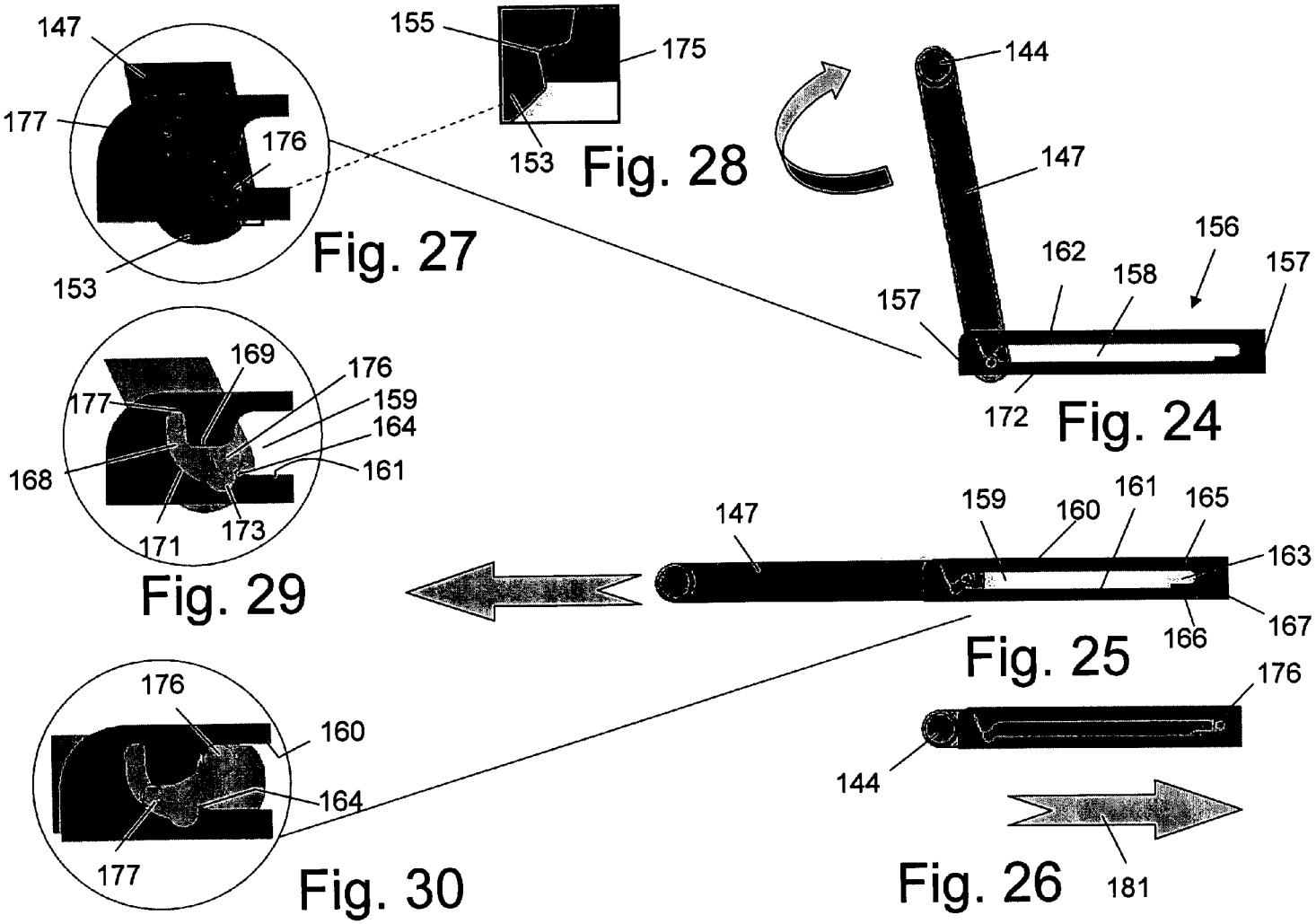
FIG. 24 is a front view of a grooved unit and of an arm engaged therewith which is in an upwardly rotated position.
FIG. 25 is a front view of a grooved unit and of an arm engaged therewith which is in an extended position.
FIG. 26 is a front view of a grooved unit and of an arm engaged therewith which is in a retracted position.
FIG. 27 is an enlarged view of FIG. 24, showing how the arm is seated in the grooved unit in one angular position.
FIG. 28 illustrates a rear view of a portion of the grooved unit and of the arm end, showing additional means to secure the arm at a given angle.
FIG. 29 is an enlarged front view of a grooved unit and of an arm engaged therewith, showing how the arm is seated in the grooved unit in another angular position.
FIG. 30 is an enlarged view of FIG. 25.
Figure 32:
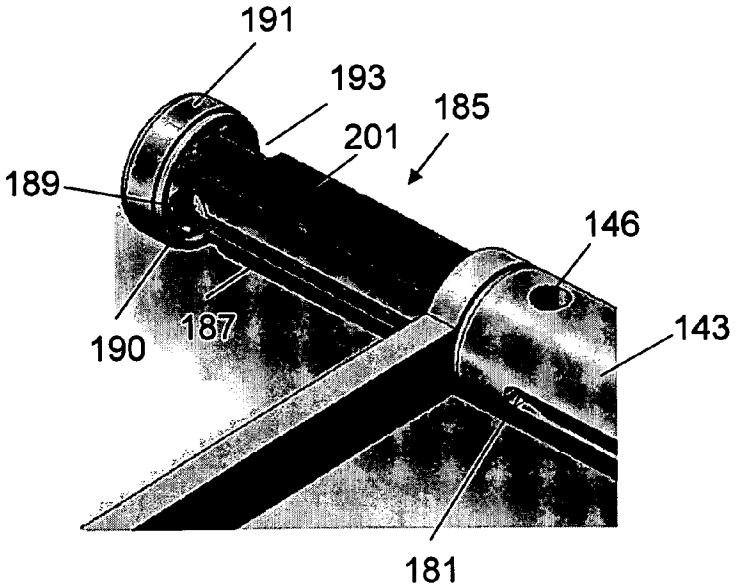
FIG. 32 is a perspective view of the drive unit actuator framework.

Arm 147 is provided at end 153 thereof with circular protrusions 176 and 177 that engage with the edges of guide groove 158. When arm 147 is in an upwardly rotated position as shown in FIG. 24, larger protrusion 176 can be seated within concave edge 173 as shown in FIG. 27 to secure arm 147 at a given angle with respect to grooved unit 156. Concave portion 155 formed on the periphery of arm end 153 and which is engageable with element 175 protruding from one face of grooved unit 156 as shown in FIG. 28 can serve as an additional means to secure arm 147 at a given angle.

Protrusion 176 can serve as an axle for arm 147 when engaged with both protuberance 164 and upper edge 169 of groove outer portion 168, as shown in FIG. 29, in order to change the angle of arm 147. As arm 147 is rotated, protrusion 177 slides within groove outer portion 168. When arm 147 is in an extended position as shown in FIGS. 25 and 30, protrusion 176 engages central portion upper edge 160. Upon application of an inwardly directed force 181, protrusion 176 is displaced within central portion 159 until it is seated within inner portion 163, as shown in FIG. 26, while grip 144 contacts outer edge 157 of grooved unit 156.

Figure 37:
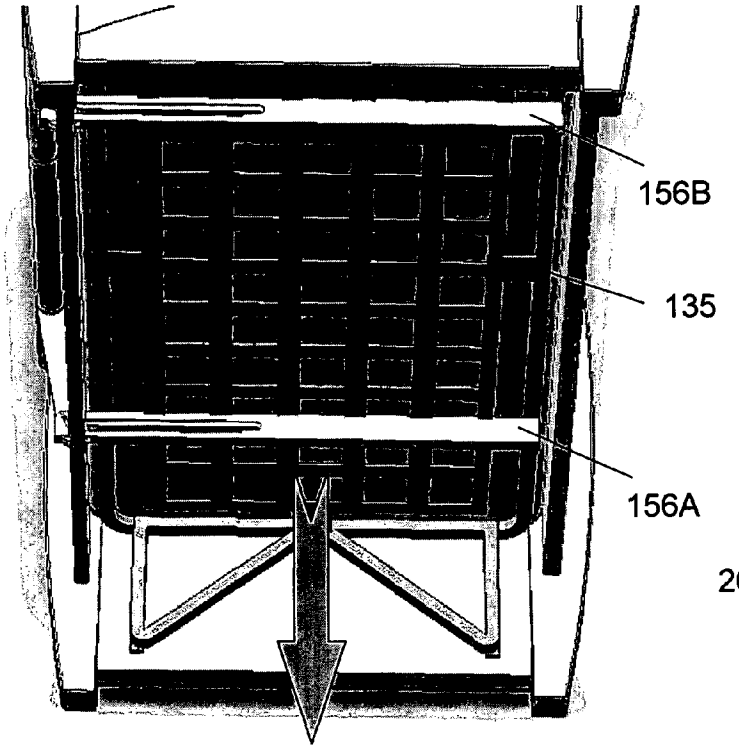
FIG. 37 is a perspective view of a mattress support underside, showing the connection of two grooved units therewith.

As shown in FIG. 37, top edge 162 (FIG. 24) of grooved units 156A and 156B is attached by any means well known to those skilled in the art to the underside of mattress support 135, which is shown in a lowered position. Outer edge 157 of the grooved units may outwardly protrude from the outer end of mattress support 135.

Figure 31:
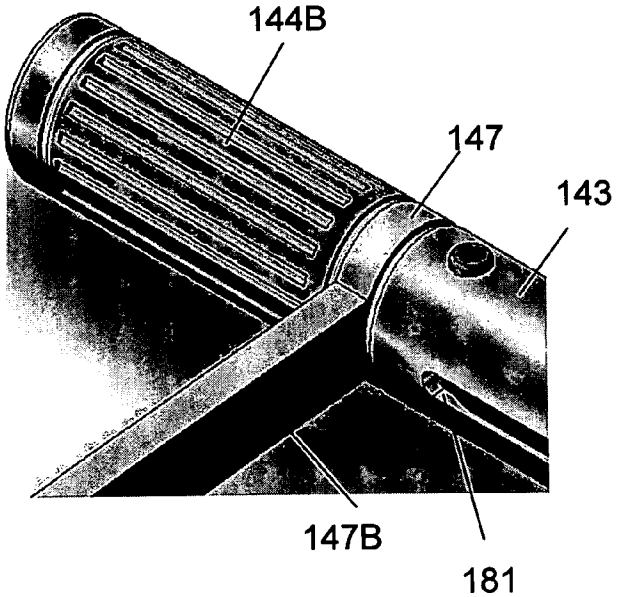
FIG. 31 is a perspective view of a rotatably mounted grip for the drive unit actuator.
Figure 34:
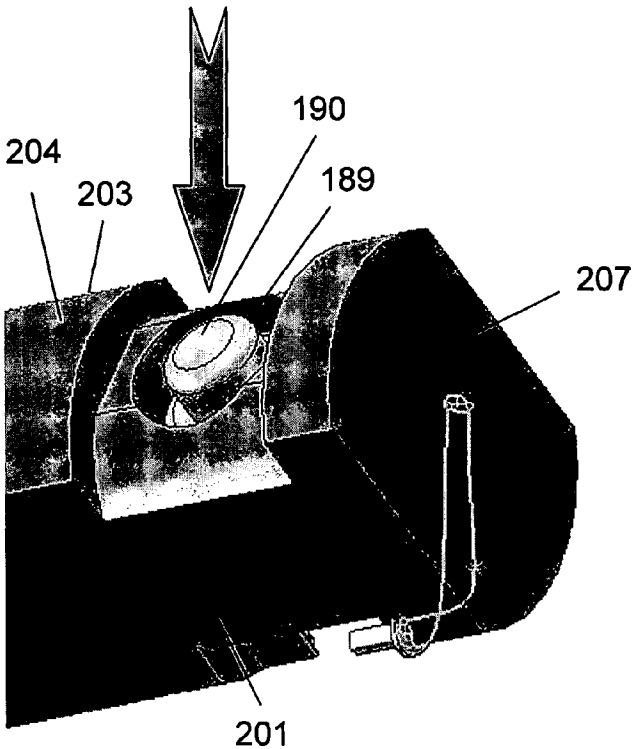
FIG. 34 is a perspective view of the drive unit actuator.

In FIG. 31, arm 147B is shown to be rotatably mounted on bar 143 by means of ring element 147 while grip 144B is rotatably mounted onto the underlying drive unit actuator framework. A longitudinal groove 181 through which a cable for disengaging the drive unit locking pin extends is formed within the periphery of bar 143.

An exemplary drive unit actuator framework 185 is illustrated in FIGS. 32-35. Framework 185 has a planar top surface 201, bottom surface 203, outer end surface 207, and inner end surface 208. In rounded side surfaces 204 and 205, each of which extending in opposite directions between surfaces 201 and 203, are formed longitudinal grooves 187 and 208, respectively, Circular end cap 191 is snapped onto outer end surface 207. Aperture 209 for mating with aperture 146 of bar 143 is bored within top surface 201 adjacent to inner end surface 208. Adjacent to outer end surface 207 within side surface 204 is formed a recess 189 in which is mounted drive unit actuator 190, e.g. a button. Cable 197 for imparting motion to the disengaging device is placed within longitudinal groove 187 provided within the periphery of framework 185 and extending from recess 189. Another recess 193 in which is seated rear side 192 of actuator 190 is formed within side surface 205. Cable 209 for imparting motion to the drive units extends in longitudinal groove 208 from recess 193.

Figure 36:
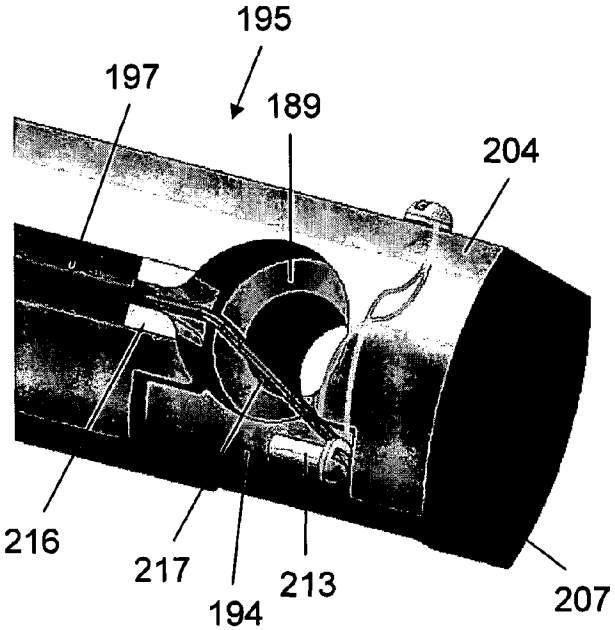
FIG. 36 is a perspective view of the disengagement device actuator framework.
Figure 35:
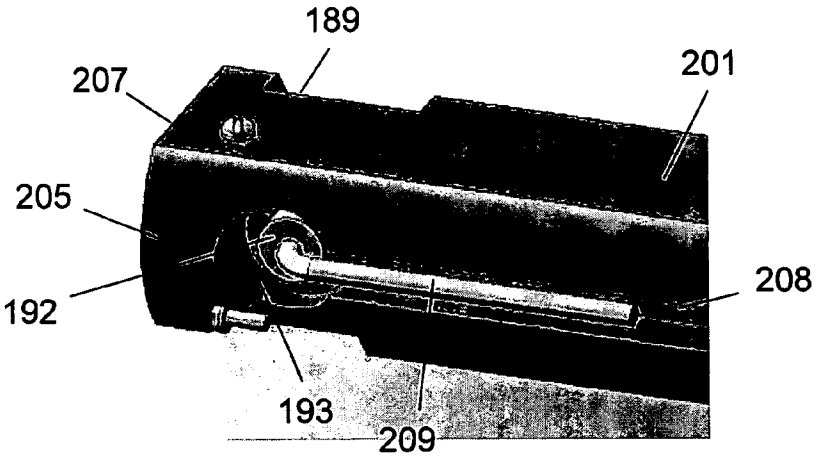
FIG. 35 is a perspective view of the drive unit actuator.

An exemplary pin release actuator framework 195 is illustrated in FIG. 36. Pin release actuator framework 195 is configured similarly to the drive unit actuator framework, and has a planar top surface, bottom surface, outer end surface, and inner end surface and rounded side surfaces. A recess 194 is formed in side surface 204 of pin release actuator framework 195, and connector 213, e.g. a screw, for connecting grip 144A (FIG. 21) to framework 195 is fixedly mounted within recess 194. A cable guide 216 is formed in side surface 204 of framework 195 adjacent to recess 189, and cable 217 attached to connector 213 is fed through cable guide 216 and combined with disengagement cable 197. Accordingly, when grip 144A, which is rotatably mounted about framework 195, is rotated, disengagement cable 197 is urged towards outer end surface 207.

Figure 33:
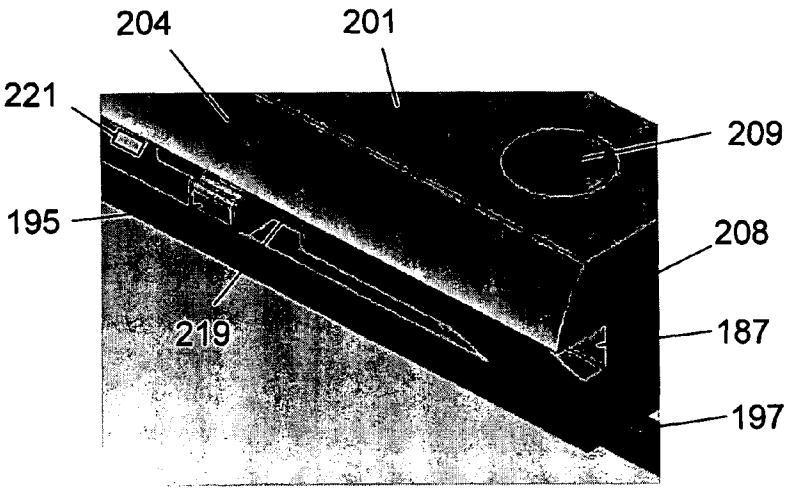
FIG. 33 is a perspective view of a disengagement device inserted within a groove formed within the drive unit actuator framework.

The disengagement device, which may be a transversally displaceable stopper 195, is illustrated in FIG. 33. The thickness of stopper 195 is substantially equal to the vertical dimension of the cavity within groove 187. A longitudinally oriented aperture is bored within stopper 195, and secondary cable 219 extending from disengagement cable 197 passes through stopper 195 via the aperture and is connected with schematically illustrated pin 221 that locks the drive unit actuator. Upon rotation of grip 144A (FIG. 21), stopper 195 is transversally displaced towards pin release actuator framework 195 (FIG. 36) and pin 221 is released from a drive unit actuator assembly to permit operation of the drive unit actuator. When drive unit actuator 190 (FIG. 34) is depressed following rotation of grip 144B, motion is imparted to the drive units by means of cable 209 shown in FIG. 35 as well known to those skilled in the art. Alternatively, the drive unit actuator may be operated without need of rotating grip 144B, such as by depressing a button.

Figure 38:
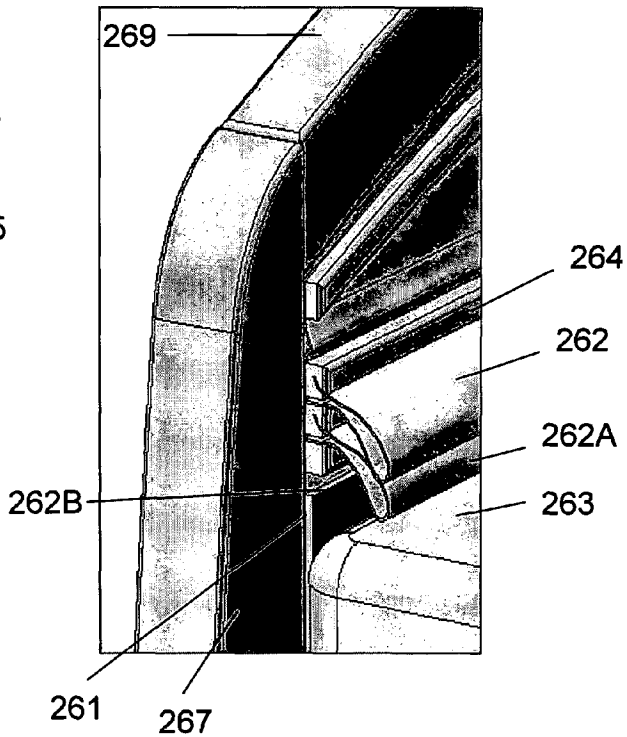
FIG. 38 is a perspective view of a crib unit, showing a plurality of curtain elements.

FIG. 38 illustrates curtain elements 262 that are used to cover each rail portion or any other apparatus associated with the crib, for added protection of a baby located on mattress 263. A plurality of horizontally disposed cross members 264, e.g. of a rectangular profile, are slidingly engageable within a vertical track formed within two opposing posts 267 of each crib end unit 269. Posts 267 are sufficiently thick so that the tracks in engagement with cross members 264 are provided at an inward portion thereof, while the rails covered by the curtain elements are provided at an outward portion thereof. An upper curtain portion 262A is affixed to the bottom surface of a first cross member 264 and a lower curtain portion 262B is affixed to the top surface of a second cross member immediately below the first cross member. When the mattress support is located at a lower position, adjacent cross members 264 are separated and curtain elements 262 are able to cover each rail portion. When the mattress support is located at a higher position, vertically oriented plate 261, which may be connected to the mattress support, contacts the lowermost cross member 264 and urges the curtain element 262 affixed thereto to be compressed.

Figure 42:
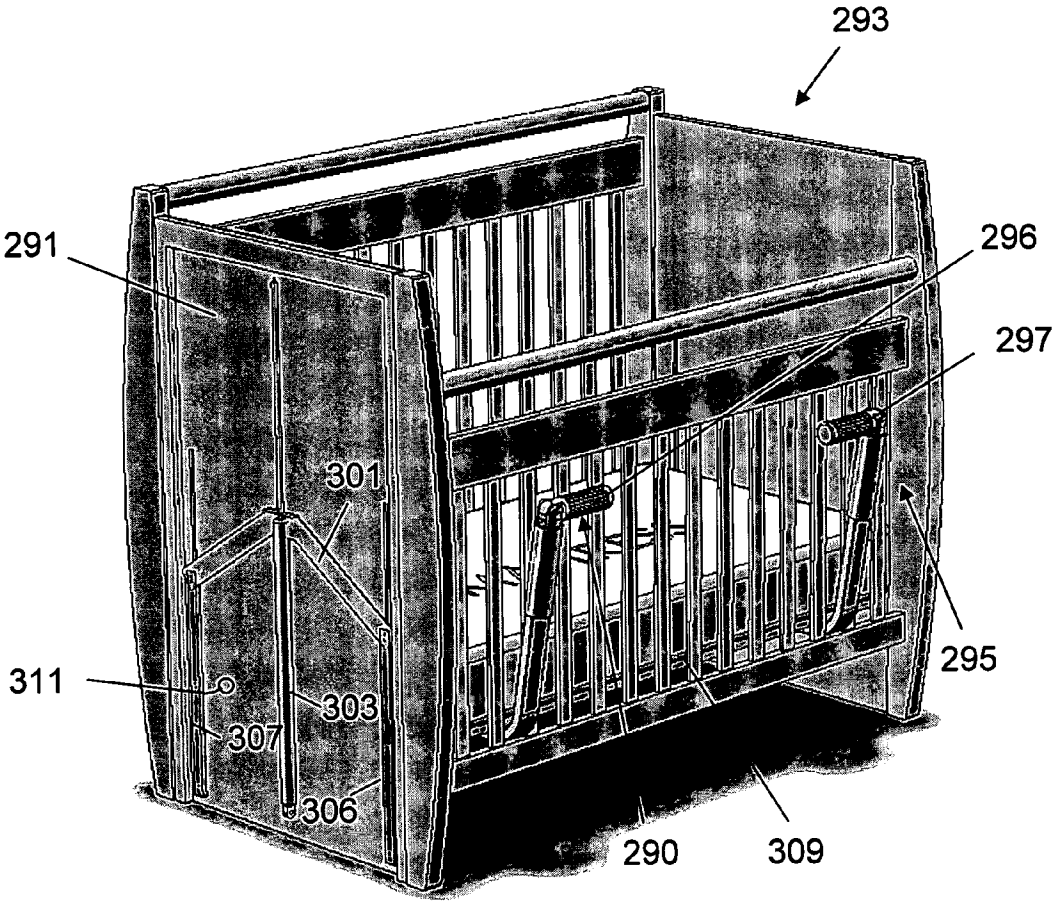
FIG. 42 is a perspective view of a baby crib, showing another embodiment of a locking device and of a stabilizing device.

Another embodiment of a locking device is illustrated in FIG. 42. Crib 293 comprises pin release actuator 290, which is separate from drive unit actuator 295. Pin release actuator 290 and drive unit actuator 295 have pivotal ends 296 and 297, respectively, by which operation of the corresponding actuator is initiated. In this embodiment, pin 311, which is schematically illustrated, normally engages mattress support 309 with end unit 291 of crib 293, to prevent vertical displacement of mattress support 309 following inadvertent actuation of the drive units. When pivotal end 296 of pin release actuator 290 is rotated, pin 311 is disengaged from end unit 291, whereupon operation of drive unit actuator 295 is made possible.

End unit 291 has an integral drive unit and rail. Vertically oriented rails 306 and 307 and drive unit 303, which is interposed between rails 306 and 307, are attached to V-shaped bracket 301 such that each rail is attached to a corresponding leg and the drive unit is attached to the centerline of the bracket. Rails 306 and 307 may be telescopingly expandable.

While some embodiments of the invention have been described by way of illustration, it will be apparent that the invention can be carried out with many modifications, variations and adaptations, and with the use of numerous equivalents or alternative solutions that are within the scope of persons skilled in the art, without departing from the spirit of the invention or exceeding the scope of the claims.

The invention claimed is:

1. A baby crib provided with a continuously height adjustable mattress support, comprising:

a) a substantially horizontal mattress support;

b) stationary end and side units and stationary crib leg posts;

c) at least one drive unit for applying a vertical force to a corresponding vertically displaceable driven component for continuous displacement thereof;

d) at least one attachment element connecting said at least one drive unit to said mattress support:

e) at least one actuator associated with said at least one drive unit for setting and continuously adjusting a height of said mattress support above a floor surface, wherein said mattress support is displaceable upon operation of said at least one actuator; and f) at least one stabilizing element that is vertically oriented for stabilizing vertical displacement of said mattress support once said at least one drive unit is actuated by holding said mattress support in a horizontal position when vertically displaced.

2. The baby crib according to claim 1, wherein said at least one stabilizing element is connected to said at least one drive unit.

3. The baby crib according to claim 1, wherein each drive unit and is concealed, for protecting a baby located on a mattress being supported by the mattress support.

4. The baby crib according to claim 1, wherein said stabilizing element comprises a vertically oriented linear bearing attached to a crib end unit.

5. The baby crib according to claim 1, wherein the stabilizing element comprises one or more vertically oriented rail portions, at least one of said rail portions being attached to a crib end unit.

6. The baby crib according to claim 5, wherein the rail portion connected to the mattress support is telescopically extendable.

7. The baby crib accordion to claim 1, wherein said at least one stabilizing element connects directly to said mattress support and said at least one drive unit separately connects to said mattress support.

8. The baby crib according to claim 1, wherein the stabilizing element comprises two vertically spaced runners that are slidably engaged with common tracks of a rail at attached to the crib end unit.

9. The baby crib according to claim 8, wherein a first attachment plate connects to the runners and also to the mattress support.

10. The baby crib according to claim 9, wherein the first attachment plate is L-shaped.

11. The baby crib according to claim 10, wherein the first attachment plate is connected to a single frame element to which the mattress support is mounted.

12. The baby crib according to claim 1, wherein the driven component is a vertically oriented piston rod of each of two cylinders attached to two end units, respectively, of the baby crib, further comprising a second attachment plate attached to the piston rod and to the frame element.

13. The baby crib according to claim 1, wherein the driven component is a vertically oriented piston rod reciprocating with respect to a corresponding cylinder, for applying a vertical force to a mattress support, said cylinder being attached to an end unit of the baby crib and interposed between two of the stabilizing elements, further comprising an angled clement having a vertically oriented leg protruding from the underside of the mattress support and connected to a corresponding stabilizing element.

14. The baby crib according to claim 12 or 13, wherein the at least one actuator is operable to displace two piston rods simultaneously.

15. The baby crib according to claim 14, wherein each drive unit is mounted within, and secured to, a corresponding crib leg post that is hollowed out, a vertically oriented groove being formed along a face of the leg post to allow insertion therein of the drive unit.

16. The baby crib according to claim 15, wherein the drive unit comprises a piston housing, a vertically oriented piston reciprocating with respect to said piston housing, and a horizontally disposed crossbar extending from said piston through the groove and connected to the mattress support.

17. The baby crib according to claim 16, wherein the actuator comprises a fixed handle for controlling a direction of displacement extending from an uppermost portion of the piston, and a release member extending from the piston and interposed between the handle and the crossbar, said release member being operable to initiate vertical displacement of the piston when pulled towards the handle.

18. The baby crib according to claim 1, wherein the drive unit comprises an electrically operated motor, a motor housing and a vertically disposed screw element which is threadedly engaged with the motor so as to be vertically displaceable, and a collar element threadedly engaged with the screw element, the attachment element extending from said collar element to the mattress support.

19. The baby crib according to claim 1, wherein each respective drive unit is electrically, hydraulically, pneumatically, or manually actuated, wherein said actuator is respectively, an electric, hydraulic or pneumatic actuator.

20. The baby crib according to claim 3, wherein the attachment element passes through a corresponding end unit while extending from a driven component to the mattress support.

21. The baby crib according to claim 1 further comprising a locking device for preventing displacement of the mattress support following inadvertent actuation of said at least one drive unit.

22. The baby crib according to claim 21, wherein the locking device comprises means for releasably engaging the drive unit actuator, a disengagement device in communication with said engaging element, and a disengagement actuator adapted to operate said disengagement device, operation of said disengagement device causing said engaging element to be released from the drive unit actuator.

23. The baby crib according to claim 21, wherein said locking device directly connects to said mattress support for preventing displacement thereof.

24. The baby crib according to claim 1, comprising two drive units positioned opposite to one another for displacing the mattress support by simultaneous actuation of said drive units, wherein said actuator is configured for simultaneously actuating said two drive units for displacing said mattress support.

* * * * *

UNITED STATES PATENT AND TRADEMARK OFFICE

CERTIFICATE OF CORRECTION

PATENT NO. : 8,484,774 B2
APPLICATION NO. : 12/733182
DATED : July 16, 2013
INVENTOR(S) : Yehuda Cohen et al.

It is certified that error appears in the above-identified patent and that said Letters Patent is hereby corrected as shown below:

ON THE TITLE PAGE:

At item (73), Assignee, change "M&J Srour Properties LLC, Piscaraway, NJ (US)" to -- M&J Srour Properties LLC, Piscataway, NJ (US) --.

Insert the following:

-- Related U.S. Application Data

(60) Provisional application No. 60/956,715, filed on Aug. 20, 2007. --.

IN THE SPECIFICATION:

Column 1, delete lines 5-8 in their entirety and insert the following:

-- CROSS REFERENCE TO RELATED APPLICATIONS

This application is the National Phase of PCT/IL2008/001138 filed on Aug. 19, 2008, which claims priority under 35 U.S.C. 119(e) to U.S. Provisional Application No. 60/956,715, filed on Aug. 20, 2007. --.

Signed and Sealed this
Sixth Day of October, 2015

Michelle K. Lee

Michelle K. Lee
*Director of the United States Patent and Trademark Office*